US009752342B2

(12) United States Patent
Waters, Jr.

(10) Patent No.: US 9,752,342 B2
(45) Date of Patent: Sep. 5, 2017

(54) FLOOD PROTECTION FOR UNDERGROUND AIR VENTS

(71) Applicant: Louis A. Waters, Jr., Bellaire, TX (US)

(72) Inventor: Louis A. Waters, Jr., Bellaire, TX (US)

(73) Assignee: Floodbreak, L.L.C., Houston, TX (US)

( * ) Notice: Subject to any disclaimer, the term of this patent is extended or adjusted under 35 U.S.C. 154(b) by 260 days.

(21) Appl. No.: 14/506,778

(22) Filed: Oct. 6, 2014

(65) Prior Publication Data

US 2016/0097212 A1 Apr. 7, 2016
US 2017/0198490 A9 Jul. 13, 2017

Related U.S. Application Data

(60) Provisional application No. 61/887,416, filed on Oct. 6, 2013.

(51) Int. Cl.

| | |
|---|---|
| ***E04H 9/14*** | (2006.01) |
| ***E06B 7/02*** | (2006.01) |
| ***E06B 7/14*** | (2006.01) |
| ***G08B 5/02*** | (2006.01) |

(52) U.S. Cl.
CPC ..... *E04H 9/145* (2013.01); *E06B 7/02* (2013.01); *E06B 7/14* (2013.01); *G08B 5/02* (2013.01)

(58) Field of Classification Search
CPC ..... E04H 9/145; E05Y 2800/428; E21F 1/08; E21F 1/16
See application file for complete search history.

(56) References Cited

U.S. PATENT DOCUMENTS 1,556,328 A * 10/1925 Hutchins ..... E02B 13/00 160/85
5,201,685 A * 4/1993 Raisanen ..... A01K 1/0058 137/527.8
7,972,081 B2 * 7/2011 Linares ..... E02B 3/104 256/13

(Continued)

FOREIGN PATENT DOCUMENTS

DE 202005012770 U1 7/2006
DE 102011085963 A1 5/2013

OTHER PUBLICATIONS

Search History Application PCT/US2014/59224.
Search Report and Written Opinion PCT/US2014/59224.

*Primary Examiner* — Katherine Mitchell
*Assistant Examiner* — Catherine A Kelly
(74) *Attorney, Agent, or Firm* — Tim L. Burgess

(57) ABSTRACT

Apparatus for allowing ventilation as usual for underground tunnels through a ventilation shaft opening to atmosphere yet preventing underground flooding from surface waters pouring through the grate, comprises an assembly that fits within the ventilation shaft and includes one or more panels held in an upright home position that allows ventilation as usual but is releasable to rotationally gravitate to a lower sealing position closing a passage between the ventilation shaft and atmosphere to prevent water from entering the underground tunnels. A panel position indicator moves from a hidden position to a visible position with lowering of the panels to visually signify that the panels are lowered and that flooding protection is activated.

24 Claims, 17 Drawing Sheets

(56) References Cited

U.S. PATENT DOCUMENTS

| | | | | |
|---|---|---|---|---|
| 8,033,753 | B2 * | 10/2011 | Waters, Jr. | E21F 1/08 405/100 |
| 9,004,814 | B2 * | 4/2015 | Petrillo | F24F 13/14 137/403 |
| 9,303,423 | B2 * | 4/2016 | Cadogan | E06B 9/13 |
| 2009/0185864 | A1 * | 7/2009 | Waters, Jr. | E21F 1/08 405/96 |

* cited by examiner

FLOOD PROTECTION FOR UNDERGROUND AIR VENTS

CROSS REFERENCE TO RELATED APPLICATION

This application claims the benefit of the filing date of U.S. Provisional Patent Application No. 61/887,416, filed Oct. 6, 2013, the disclosures of which are incorporated by reference.

STATEMENT REGARDING FEDERALLY SPONSORED RESEARCH AND DEVELOPMENT

Not applicable

BACKGROUND OF THE DISCLOSURE

Technical Field

This invention relates to blocking flooding water from entering underground ventilation passages.

Background Art

Surface storm waters entering and flooding underground tunnels and chambers through ventilation ducts connecting the underground chambers or tunnels to air at ground surface affect without limitation, underground transportation tunnels for road vehicles, trains, and subways, and underground chambers, such as associated with a complex of connecting tunnels and shafts, for example as used for such things as underground hydroelectric-power plants, or with underground utilities which require ventilation, such as underground transformer rooms.

In a typical subway ventilation arrangement, ventilation ducts or shafts are incorporated into subway systems near stations to exhaust stale pushed air as the train nears a station and to pull in fresh outside air as a train leaves a station, Also reducing the "piston effect" of air being forced through the tunnels at high speeds by moving trains. Typically, a ventilation duct communicates from an underground tunnel and terminates in a ventilation shaft structure below grade level that opens to the atmosphere at grade level such as a sidewalk where the opening is covered by a subway grating.

Subways have systems for handling water. When it rains, water runs down stairwells, onto platforms and thence onto tracks, and some gets in the ventilation systems through the surface grates. Drains beneath the tracks pipe water to underground sumps in pump rooms next to the subway tracks. Pumps pull the water up to pressure relief manholes open to the atmosphere at street level; from there the water drains under gravity flow into city storm sewers. The problem is that in heavy rains, storm sewers are overwhelmed and flush water back into the streets, flooding the streets with water inundates sidewalk and pours down through subway grates into the ventilation system thence into the tunnels and onto the tracks. The pumping system can only return water to the flooded street; from there the water reenters the flood pool pouring into the ventilation system, defeating the pumping system as a means of controlling subway flooding. The problem is especially acute in cities like New York and Lower Manhattan, which is low-lying, vulnerable to storm surges and dotted with grade-level grates, stairwells and other points of entry for running water into the subways.

One solution for reducing entrance of runoff water from sidewalk grate openings through the ventilation ducts down into the underground systems was raising the subway ventilation grates above sidewalk level, as was done in some locations in New York City in Manhattan, Queens and Brooklyn after flooding from a severe rainstorm in 2007. This not only was costly to implement but also sacrificed much of the available sidewalk area available for pedestrians. In advance of the super storm Sandy in 2013, when predicted storm surge and high tides in addition to heavy rains signaled flooding of subways, workers resorted to sandbags and fastening plywood covers over subway ventilation grates to try to prevent flooding. Sandy was testament to flood hazards of subways and vented subterranean structures. Fastening plywood covers over large numbers of air vent grates in a short period of time as a solution is an imperfect labor and materials intensive process and can be too little too late, as was made clear by subway flooding from Sandy. A simpler, faster, relatively inexpensive and more effective method of preventing flooding through sidewalk air vent gratings is needed.

DETAILED DESCRIPTION OF EMBODIMENTS

Figure 1:
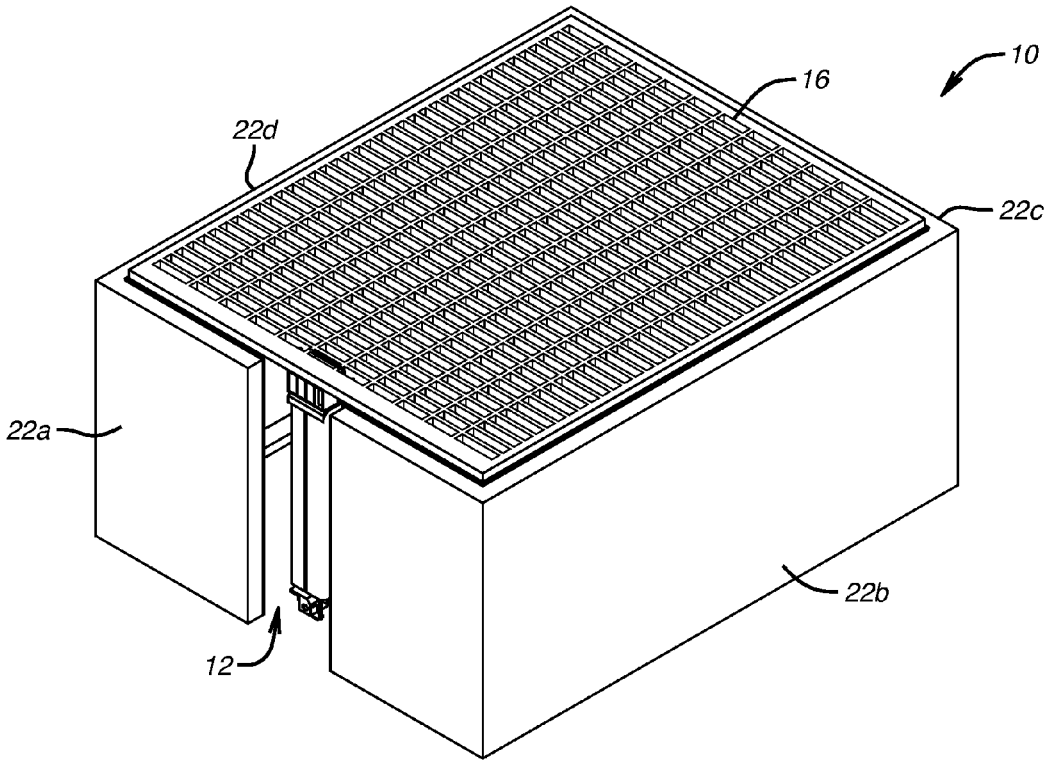
FIG. 1 is an isometric view of an exemplary embodiment of the invention employing a pair of panels.

In accordance with this invention apparatus is provided for allowing ventilation as usual for underground tunnels through a ventilation shaft covered by grating opening to atmosphere yet on threat of flooding operable to prevent underground flooding from surface waters pouring through the grating. The concepts embodied in the exemplary embodiments of such apparatus described herein have application to any system in which an atmospheric opening communicates with a ventilation duct for an underground chamber or tunnel or other underground structure requiring ventilation, and through which opening substantial volumes of water can enter, whether by heavy rain or by storm surge propelled by hurricane or tropical storm or otherwise.

The exemplary embodiments described herein comprise an assembly that fits within the ventilation shaft under the grating. One or more panels rotatably mounted and held in an upright home position by a releasable holder allow ventilation as usual in normal times, but on threat of flooding are releasable to allow the one or more panels to rotationally swing downward under the force of gravity to a position closing the bottom of the assembly, preventing water from passing into ventilation ducts leading to underground tunnels or chambers. In an exemplary embodiment, the holder of an apparatus exemplarily embodying the invention is manually accessible for manual release of the one or more panels. This is advantageous for crew operation of the ventilation shaft guards of this invention in which the members of the crew disperse and move from shaft to shaft and actuate panel closure of the shafts. In an exemplary embodiment, the holder of an apparatus exemplarily embodying the invention may be releasable by an electrically actuated transducer. Thus, for example, a plurality of ventilation shafts along a run of underground track all guarded by apparatus in accordance with this invention may have a panel holder releasable by an electrically actuated transducer can be closed using the transducer, either by crews doing so by flipping a hidden switch in or adjacent the shaft or by remote control from a central operations center or the like. As well known in the art, a transducer converts electrical energy into linear mechanical movement. An example is a solenoid. In an exemplary embodiment, the holder of an apparatus exemplarily embodying the invention may be both manually accessible for manual release of panels and also releasable by an electrically actuated transducer. The manual option is exercisable if electricity is lost.

In an exemplary embodiment, one or more downwardly rotatable panels may be used, mounted in an upright home position not obstructing the ventilation passage that fluidly communicates the underground ventilation duct with the atmospheric opening of the ventilation shaft, to allow ventilation as usual when there is no flooding threat. In one exemplary embodiment, a single panel is mounted in the home position to a side of such a passage to alone gravitationally fall from home position to a passage closing position across the entirety of the passage to protect the underground ventilation duct from flooding. In another exemplary embodiment, a pair of panels is mounted on opposite sides of the passage, to gravitationally fall from home position down toward each other to passage closing positions to combine to close the passage. In yet another exemplary embodiment, a pair of panels is mounted centrally in the passage for rotation of the panels in directions opposite each other from the home position to a lower passage closing position. An advantage of paired panels is that they may be used to close a passage that is wider than it would be feasible for a single taller panel to close.

In an exemplary embodiment in a home position the one or more panels are tucked away from pedestrian causal view through the grating opening to atmosphere covering the shaft. In an exemplary embodiment, the lowering of the one or more panels elevates a "tell-tale" panel position indicator that is normally out of sight when there is no flooding threat. The lowering of the one or more panels elevates the tell-tale indicator above the grating surface to signify to an on-the-ground inspector that the panels are activated for flooding protection. The indicator is suitably marked for at-a-glance visible detection, such as by a distinctive color. This allows a supervisor to move quickly over many sidewalk vent sites to determine if an area of sites to be protected has or has not yet been activated by a crew under his supervision.

In the descriptions of exemplary embodiments of the invention that follow, reference is made to the accompanying drawings, which form a part hereof and in which are shown, by way of illustration, specific embodiments in which the invention may be practiced. Specific details disclosed herein are in every case a non-limiting embodiment representing concrete ways in which the concepts of the invention may be practiced. This serves to teach one skilled in the art to employ the present invention in virtually any appropriately detailed system, structure or manner consistent with those concepts. It will be seen that various changes and alternatives to the specific described embodiments and the details of those embodiments may be made within the scope of the invention. Because many varying and different embodiments may be made within the scope of the inventive concepts herein described and in the specific embodiments herein detailed, it is to be understood that the details herein are to be interpreted as illustrative and not as limiting.

For illustrative purposes of an application of the concepts herein disclosed for blocking entrance of water into a ventilation duct, the embodied concepts are described in reference to a specific ventilation environment. The exemplary application is for a subway system. In the specific embodiments described herein as examples, it is assumed the atmospheric opening through which flooding waters enter has a rectilinear shape, as for grated grade level sidewalk openings for subway ventilation systems, which at least in New York City typically are rectangular. Although the descriptions of specific embodiments relate to a rectilinear shape and for a particular environment, the invention does not require that the opening be rectilinear or that embodiments of the invention conform to a rectilinear shape or that the atmospheric opening be at grade level. The elements of the invention can be configured to fit within the downwardly vertically projected dimensions of any ventilation shaft surface opening serving any underground tunnel, chamber, room or other underground structure, whether rectilinear, circular or oval or some other shape.

The various directions such as "upper," "lower," "bottom," "top," "transverse", "perpendicular", "vertical", "horizontal," and so forth used in the detailed description of embodiments are made only with respect to easier explanation in conjunction with the drawings. The components may be oriented differently while performing the same function and accomplishing the same result as the embodiments herein detailed embody the concepts of the invention, and such terminologies are not to be understood as limiting the concepts which the embodiments exemplify.

The term "perpendicular" means substantially at a right angle to a reference to a degree that if not absolutely a right angle will not materially adversely affect the arrangement and function of the element described as perpendicular. The terms "vertical" or "vertically" include but are not limited to literal vertical and generally mean oriented up and down with respect to the earth's horizon to a degree that if not absolutely vertical will not materially adversely affect the function of the element described as vertical. Similarly, the terms "horizontal" or "horizontally" include but are not limited to literal horizontal and generally mean not out of level with respect to the earth's horizon to a degree that will materially adversely affect the function of the element described as horizontal.

As used herein, the use of the word "a" or "an" when used in conjunction with the term "comprising" (or the synonymous "having" or "including") in the claims and/or the specification may mean "one," but it is also consistent with the meaning of "one or more," "at least one," and "one or more than one." In addition, as used herein, the phrase "connected to" means joined to or placed into communication with, either directly or through intermediate components.

In an exemplary embodiment, apparatus for allowing ventilation as usual through a ventilation shaft to an underground ventilation duct fluidly communicating through the ventilation shaft to an atmospheric opening of the shaft and on threat of flooding operable to prevent downward flow of surface water into the underground ventilation duct comprises a support for suspension in the shaft. The support defines a passage between top and bottom openings of the support for fluid communication of the ventilation duct up through the support to the atmospheric opening. One or more stops are arranged within and connect to the support below the top opening of the support, in an exemplary embodiment, proximate the bottom opening, without obstructing the passage. One or more panels are mounted in the support for rotation of the panels from or to an upright home position where the panels do not obstruct the passage. The one or more panels have a profile that closes the passage have when the one or more panels gravitationally rotate to the passage closing position. A panel holder includes moveable members holding the one or more panels in the upright home position and includes a handle operable to move the moveable members above the panels to release the panels and allow the panels to gravitationally rotate downwardly from the upright home position to a lower passage closing position where further rotation is prevented by the one or more stops.

A ventilation shaft in which an exemplary embodiment of the invention may be fitted may not be vertical, and so the orientation of the passage of the support may not be vertical but at some angle relative to horizontal that allows the panels to gravitationally rotate under their own weight to a position closing the bottom opening in the support. A large part of the time the shaft in which the support of an exemplary embodiment of this invention is fitted will be vertical, in which case the rotational axis or axes of the panels is horizontal.

In an exemplary embodiment of the invention, the support may be a space frame. In an exemplary embodiment of the invention employing a space frame, the space frame includes flanges configured to extend over a top of walls of the shaft, for suspension of the support in the shaft.

In another exemplary embodiment of the invention, the support is a liner wall, sized to internally line the shaft between the ventilation duct and the atmospheric opening. In an exemplary embodiment of the invention employing a liner wall, the liner wall is supported in the shaft from a frame having flanges transverse to the liner wall to extend over a top of walls of the shaft.

In an exemplary embodiment for application in a vertical ventilation shaft where the atmospheric opening is rectilinear, the support of the apparatus may comprise a four-sided box inclusive of sidewalls sized to internally fit in the vertical shaft between a ventilation duct and the atmospheric opening. Such support has flanges transverse to said sidewalls for overlaying a top of the vertical shaft to hold the support box in said shaft. In an exemplary box embodiment sidewalls adjacent one another may include a base having rounded corners with a first radius of curvature and distal portions of the supported rotatable panels have rounded corners with a radius of curvature substantially the same as said first radius of curvature of the sidewall corners they sweep when rotating to the passage closing position. In an exemplary embodiment, the panels include seals for sealing the passage when the panels are in the passage closing position.

In an exemplary embodiment, the panels are attached to one or more mounts rotatable on at least one axis supported by and horizontally disposed within the support. In an embodiment, a mount comprises at least one hinge member comprising a stationary member connected to the apparatus support, a movable member and a hinge pin interconnecting the stationary and movable members. In an exemplary embodiment, the support may comprise a hinge mount mounting member unobstructively horizontally spanning across the support passage supported between opposed sides of the support proximate the bottom opening, and the stationary member may be connected to the hinge mount mounting member. Each panel has a proximal and distal portion, and each moveable hinge member attaches to the proximal portions of each panel. By unobstructively is meant that the hinge mounting member does not block movement of air though the passage.

In an exemplary embodiment a beam unobstructively horizontally spans across the support passage and connects to opposed sides of the support proximate the top opening. By unobstructively is meant that the beam does not block movement of air though the passage. In an embodiment such opposing sides are the same as the sides to which the hinge mount mounting member is connected, and the beam and the hinge mount mounting member are centered in the passage. In an embodiment a plurality of straps connects the hinge mount mounting member to the beam.

An apparatus embodying the invention may have a tell-tale panel position indicator in a position also out of sight from casual view of a pedestrian under the atmospheric opening normally covered by a grate. In an exemplary embodiment, the indicator is moveable to a viewable position by structure moved by gravitational rotation of one or more of the panels toward the passage closing position, and is moveable back to the out of sight position on rotation of the panels back to home position.

In an exemplary embodiment, a tell-tale panel position indicator of an apparatus exemplarily embodying the invention may comprise a vertical rod with an upper terminus positioned at an elevation lower than the atmospheric opening when the one or more panels are in upright home position and a lower terminus moveably connected to a projection from a said mount (for non-limiting example, a finger extending from a moveable hinge member) to move the rod vertically upwardly to elevate the upper terminus above the atmospheric opening when the one or more panels rotates downwardly to the passage closing position. In an exemplary embodiment, the upper terminus of rod may be marked by color for readily visible identification when elevated, for example, by a bright florescent safety color or one visible by black light if other lighting is compromised or unavailable.

In an exemplary embodiment in which the pair of panels are mounted centrally in the passage for rotation of the panels in directions opposite each other from or to the upright home position, the panel holder comprises a pair of latches and the mentioned panel holder moveable members comprise a pair of latch members. The latches are positioned to move the latch members to an upper portion of the panels and hold the panels upright in the home position. Each latch member is moveable to free its hold on a panel to allow the panel to rotate from upright to the horizontal position. The handle may move the latch members rotably upward or may move them linearly upward. In an exemplary embodiment, the latches comprise a spring, movement of the latch members is linearly vertical, and the latches are spring biased to vertically extend the latch members. Retraction of the extended latch members loads the spring to exert a force resisting retraction and tending to extend the latch members.

As mentioned above, an embodiment may include a beam unobstructively horizontally spanning across the passage inside the apparatus support. In an exemplary embodiment that includes such beam, the panel holder latch members extend below the beam and straddle the panels and hold them in the upright home position. The handle of the panel holder extends above the beam and is retractable upwardly to raise the latch members above the panels to release the panels and allow the panels to gravitationally rotate downwardly to the passage closing position.

In another exemplary embodiment in which the latches comprise a spring, the panel holder comprises a latch catch staff vertically extending upwardly from each latch member and the handle is structured to catch and retain each staff at a position of rest where the latch member is extended, to retain such catch upon movement of the handle upwardly to retract the latch, and to disengage the staffs when the latch member is retracted sufficiently to free the panels for rotation to a passage closing position, allowing the spring to extend the latch member.

In an exemplary embodiment of the type described in the next preceding paragraph, each latch member may have an outer surface in its lower portion configured for sliding engagement with a surface of an upper inner side of a panel to cause the panel when raising from horizontal to slide on the outer surface of the latch member and push the latch member into a refracted position, allowing the panel to pass by the latch to attain the upright home position at which the spring extends the latch member to hold the panels in the home position.

In mentioned embodiments in which a beam unobstructively horizontally spanning across said passage, the upright home position of the panels tucks the panels under the beam free from pedestrian causal view through the atmospheric opening typically covered by a grate over the opening. In an embodiment, the panel holder is also out of sight under the atmospheric opening typically covered by a grate free from casual view of a pedestrian. The panels and holder are positioned away from casual view by a pedestrian to reduce if not avoid gratuitous tampering with the apparatus and unwanted deployment of the panels by vandals.

In the descriptions of exemplary embodiments that follow, the passage closing position is one in which the panel or panels are horizontal. The concept of the invention is not limited to this disposition. Stops for stopping panel lowering may be positioned to stop the downward travel above horizontal and still close a ventilation passage. The described embodiments are only illustrative of examples in which the concepts of the invention may be implemented.

Figure 2:
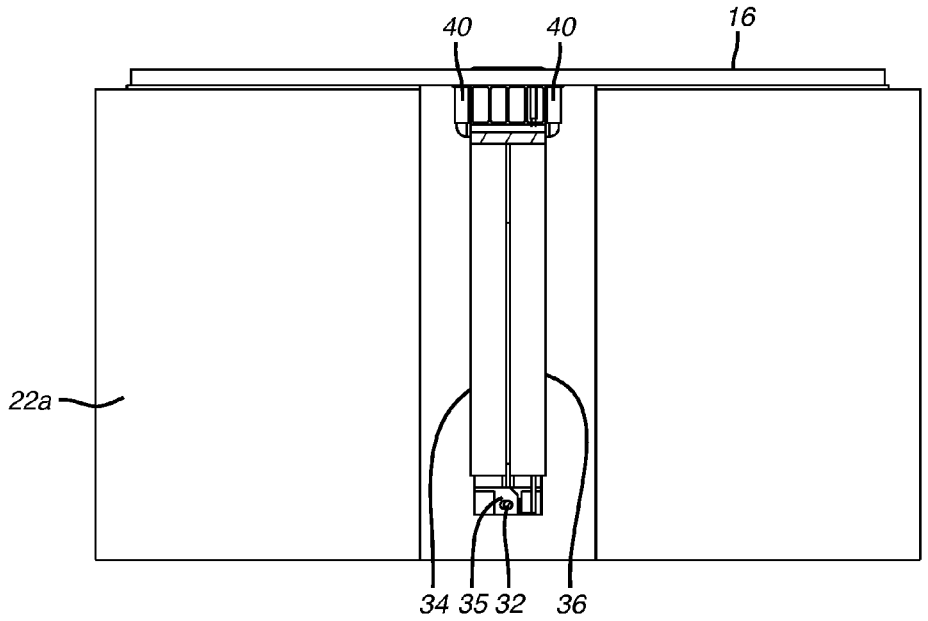
FIG. 2 is a side elevation view of the embodiment of FIG. 1.
Figure 3:
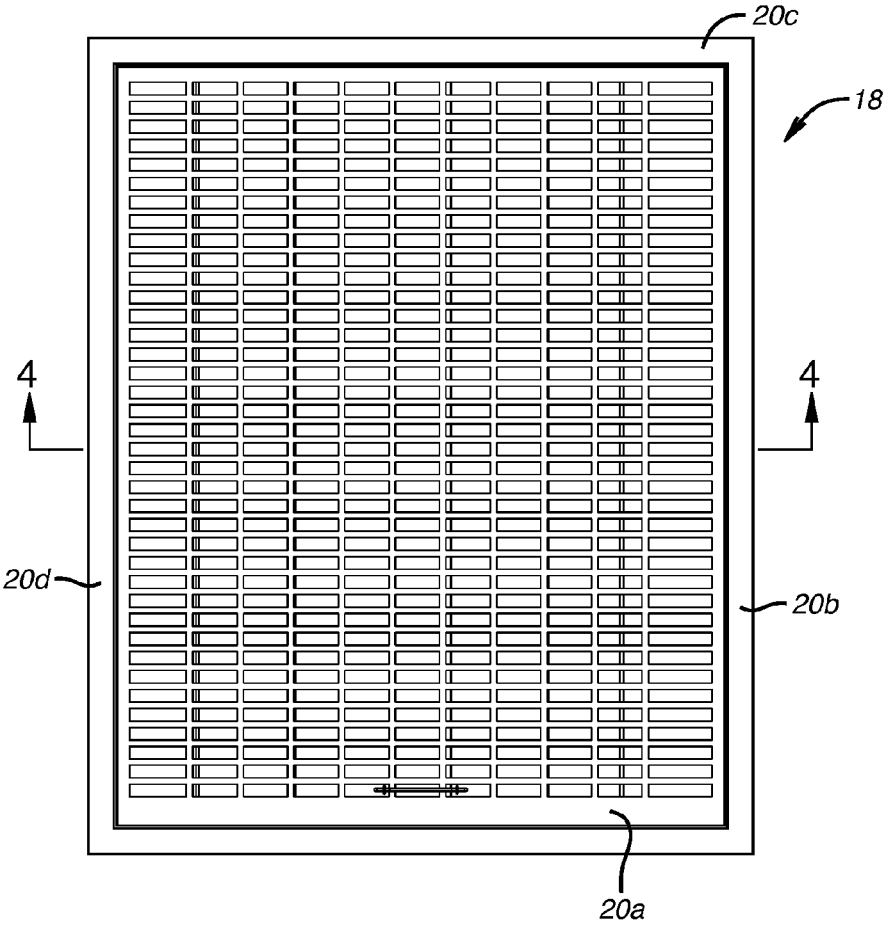
FIG. 3 is a top view of the embodiment of FIG. 1.

Referring now to the drawings and initially to FIGS. 1-5, an exemplary embodiment of an apparatus 10 in accordance with this invention for preventing downward flow of surface water into an underground ventilation duct fluidly communicating through a ventilation shaft 12 to an atmospheric opening 14 at a grating 16 surmounting ventilation shaft 12 is depicted. FIGS. 1 and 2 depict apparatus 10 installed in a ventilation shaft 12. In this embodiment, the ventilation shaft is rectangular and comprises vertical walls 22 (22*a*, 22*b*, 22*c*, 22*d*). A ventilation duct in fluid communication with vertical ventilation shaft 12 is not depicted as it is not part of the immediate environment in which the apparatus fits but will be understood as fluidly communicating with vent shaft 12.

Apparatus 10 comprises a self-contained drop-in assembly. By drop-in is meant that the assembly is lowered into ventilation shaft 12 from above the shaft after grating 16 is removed. Assembly 10 comprises a four-sided vertical box 18 open at bottom and top and having upper flanges 20 (20*a*, 20*b*, 20*c*, 20*d*) perpendicular to the sides of the box to horizontally extend and rest atop vertical walls 22 (22*a*, 22*b*, 22*c*, 22*d*) of ventilation shaft 12. Sidewalls 24 (24*a*, 24*b*, 24*c*, 24*d*) of box 18 are supported by and hang from flanges 20 that in turn are supported by vent shaft walls 22*a*, 22*b*, 22*c*, 22*d*.

Figure 4:
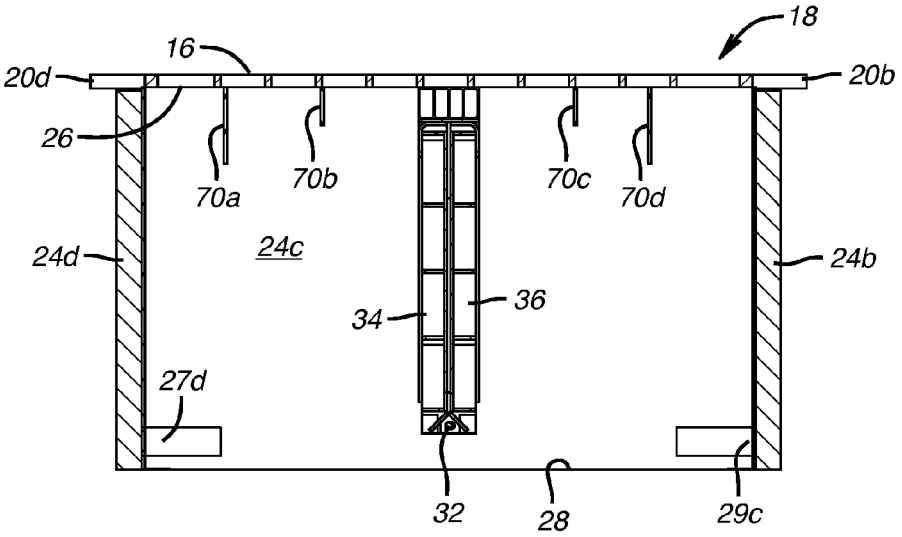
FIG. 4 is a side sectional view of the embodiment of FIG. 1 along the sectional lines 4-4 of FIG. 3.
Figure 5:
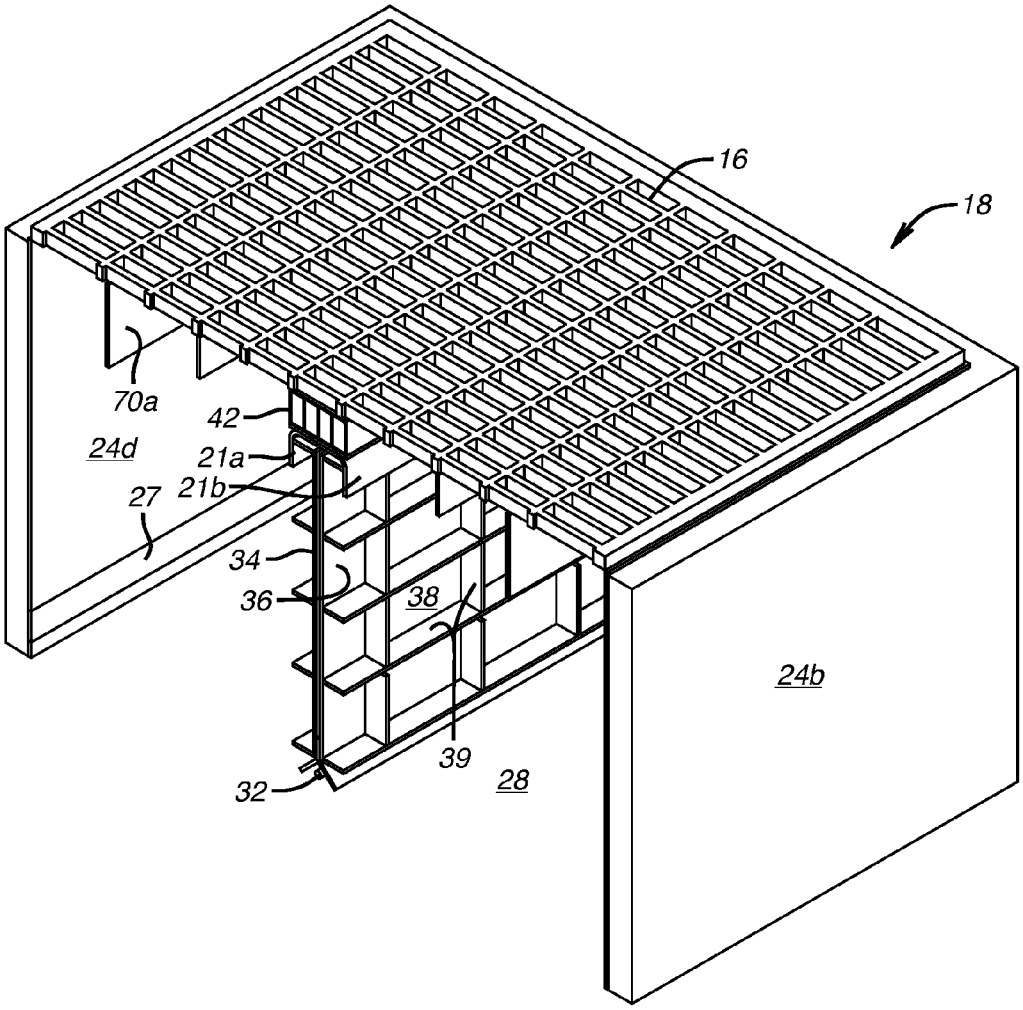
FIG. 5 is an isometric view of the embodiment of FIG. 1 with a side wall removed to reveal certain interior structure of the embodiment.
Figure 6:
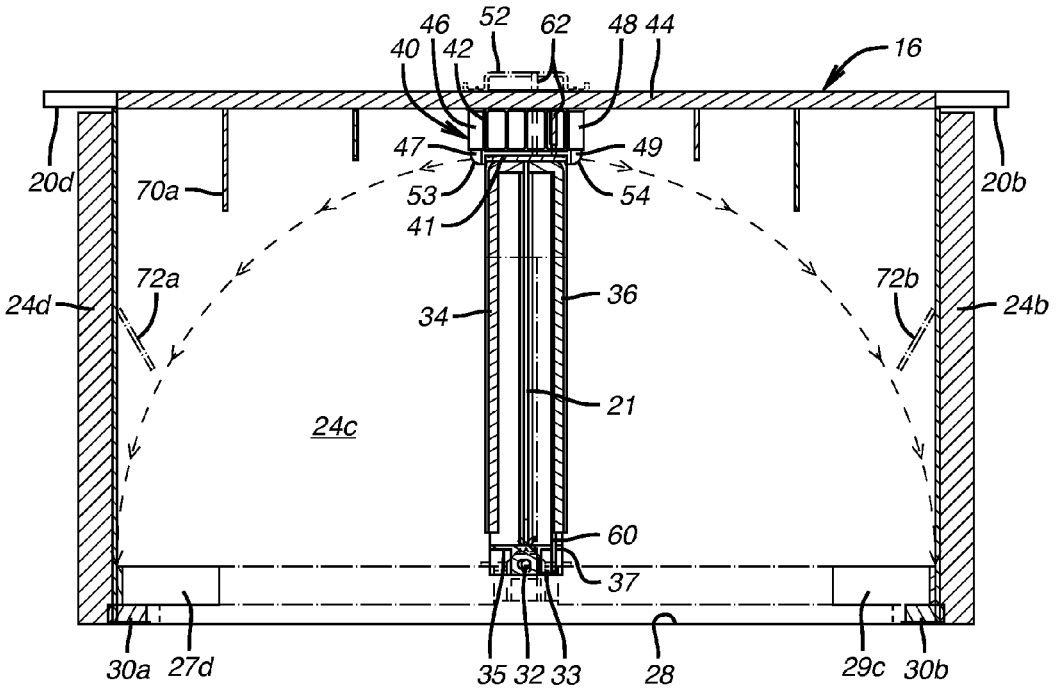
FIG. 6 is a schematic side sectional view (sidewall removed) of the embodiment of FIGS. 1-5 depicting by dashed arrowed line a trajectory of panels released in the activation sequence illustrated in FIGS. 7-12.

In FIGS. 1 and 2, shaft wall 22*a* is shown with a central portion artificially removed, as is a central portion of sidewall 24*a*, so some of the internal structure of assembly 10 is visible from a perspective view. In FIG. 5, sidewall 24*a* is entirely removed also so some of the structure of assembly 10 inside sidewalls 24 can be seen by perspective. FIG. 4 shows the assembly 10 in cross section viewed along the lines 4-4 indicated in FIG. 3. FIG. 6 is another vertical cross sectional view.

The four sidewalls 24*a*, 24*b*, 24*c*, 24*d* of box 18 vertically fit inside the four vertical ventilation shaft walls 22*a*, 22*b*, 22*c*, 22*d*. Sidewalls 24*a*, 24*b*, 24*c*, 24*d* together define top and bottom openings 26, 28 for fluid communication of the ventilation duct (not shown but understood feeding vertical vent shaft 12) up through sidewalls 24 to the atmospheric opening 14 guarded by grating 16. So installed, the four sided box 18 forms a lining open at top and bottom for the four sides of the ventilation shaft also open at top and bottom.

Sidewalls 24 support a plurality of stops 30*a*, 30*b*, 30*c*, 30*d* located respectively at intersections of sidewalls 24*d* and 24*a*, 24*a* and 24*b*, 24*b* and 24*c* and 24*c* and 24*d* at vertically identical lower extents of the sidewalls. A baseboard 27 has curved corners 27*a*, 27*d* located immediately above stops 30*a* and 30*d*. A baseboard 29 has curved corners 29*b*, 29*c* located immediately above stops 30*b* and 30*c*, respectively.

Referring now additionally to FIGS. 6-15, the embodiment of FIGS. 1-5 is shown with sidewall 24*a* removed by a vertical section just past sidewall 24*a* allowing a look inside box 18. For further simplicity of exposition, some additional detail in the embodiment of FIGS. 1-6, for example, flanges 20, are omitted in FIGS. 7-15. A horizontal axle 32 that is perpendicular to opposing sidewalls 24*a*, 24*c* is fixedly supported on bearing surfaces positioning axle 32 adjacently above bottom opening 28 of sidewalls 24. A pair of panels 34, 36 longitudinally span between opposing sidewalls 24*a*, 24*c* and are rotationally mounted on horizontal axle 32 by rotatable mounts 35, 37 respectively. Mount 35 allows a panel 34 to rotate downwardly counterclockwise; mount 37 allows panel 36 to rotate downwardly clockwise. As depicted in FIGS. 1-2 and 4-6, panels 34, 36 are in an upright home position.

Panels 34, 36 have an outer skin 38 at least on upper surfaces (the surfaces of panels 34, 36 facing each other in the upright home position) and have internal cross braces 39 for rigidity (e.g., FIG. 5). The axis of axle 32 and the vertical placement of stops 30 are coordinated relative to the thickness of panels 34, 36 with their internal cross braces 139 such that when panels 34, 36 rotate gravitationally from vertical, the rotation is ended by stops 30 located where the panels will be horizontally disposed. Panels 34, 36 have a vertical height 41 above axle 32 sufficient to close bottom opening 28 of box 18 when panels 34, 36 gravitationally rotate to the horizontal. Panel 34 has rounded corners at its distal end that have a radius of curvature substantially the same as the radius of curvature of corners 27*a*, 27*d* of baseboard 27. Panel 36 has rounded corners at its distal end that have a radius of curvature substantially the same as the radius of curvature of corners 29*b*, 29*c* of baseboard 29. Wiper seals 21*a*, 21*b* are fitted respectively to the perimeters of panels 34, 36 except where the panels are rotationally attached to axle 32. Wiping seal 21*a* fitted to panel 34 wipes the inner surface of sidewall 24*d* and the left halves of sidewalls 24*a* and 24*c*, and wipes baseboard 27 including the rounded corners 27*a*, 27*d* of baseboard 27 as panel 34 descends to horizontal rest on stops 30*a*, 30*d*. Wiping seal 21*b* fitted to panel 36 wipes the inner surface of sidewall 24*b* and the right halves of sidewalls 24*a* and 24*c*, and wipes baseboard 29 including the rounded corners 29*b*, 29*c* of baseboard 29 as panel 36 descends to horizontal rest on stops 30*b*, 30*c*. A gasket seal 23 spans the proximal ends of bases of panels 34, 36 above axle 32 to seal bottom opening 28 at the proximal ends or bases of the panels. The rounded corners of panels 34, 36 and baseboards 27, 29 allow the wiper seals 21*a*, 21*b* to fully seal the perimeter of the panels where the panels intersect as well along the lateral sides of the panels.

Figure 10:
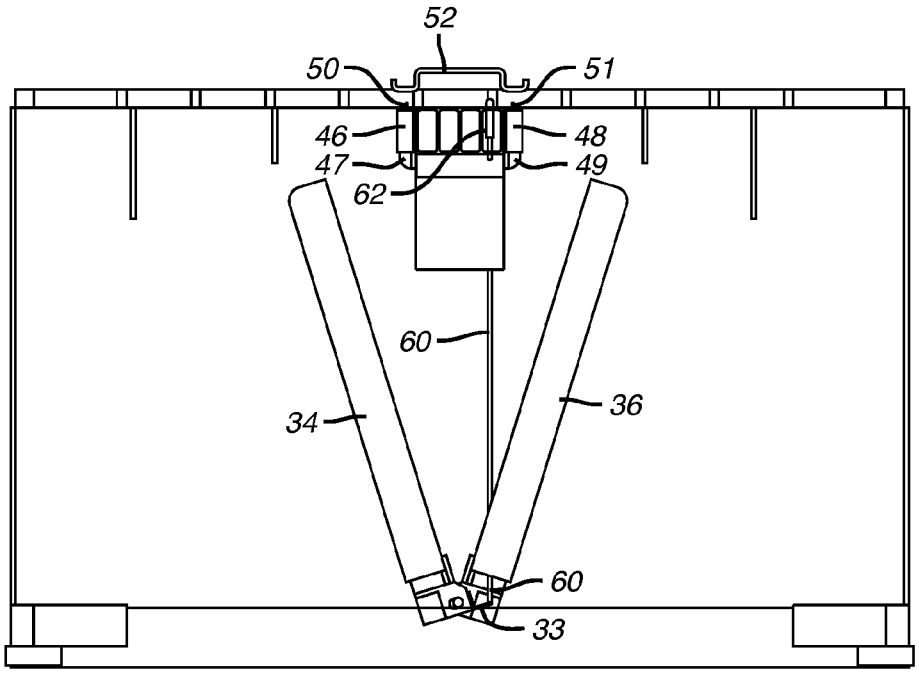
FIG. 10 is a schematic view progressed from FIG. 9 to show a released panel snap shot in the activation sequence of the embodiment of FIGS. 1-6.
Figure 11:
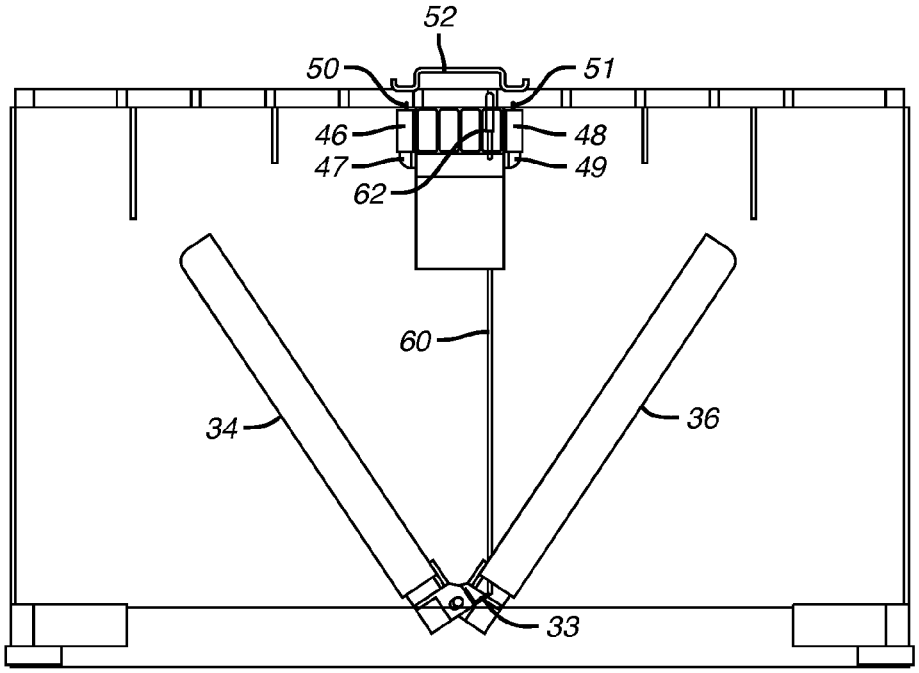
FIG. 11 is a schematic view progressed from FIG. 10 to show a further released panel "snap shot" in the activation sequence of the embodiment of FIGS. 1-6.
Figure 12:
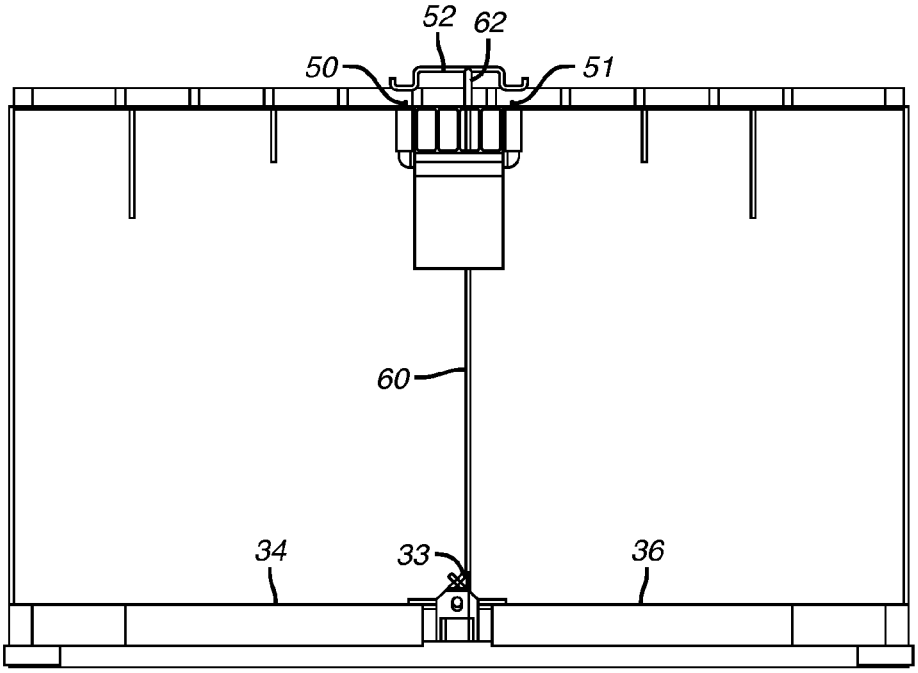
FIG. 12 is a schematic view showing panels in a passage closing position stage in the activation sequence of the embodiment of FIGS. 1-6.
Figure 13:
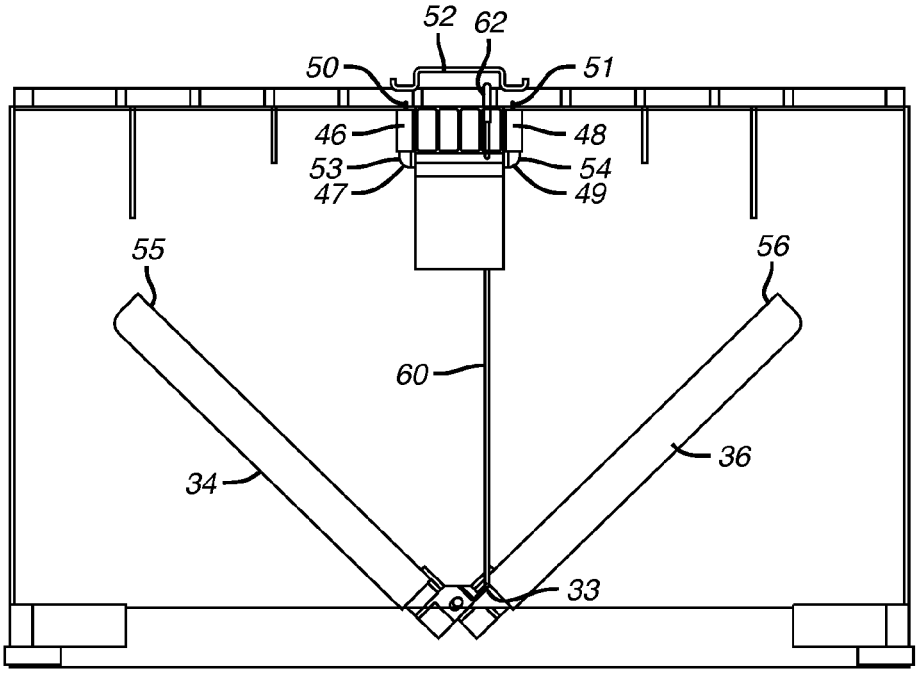
FIG. 13 is a schematic view progressed from FIG. 12 showing a panels raising stage in the operation of the embodiment of FIGS. 1-6.
Figure 14:
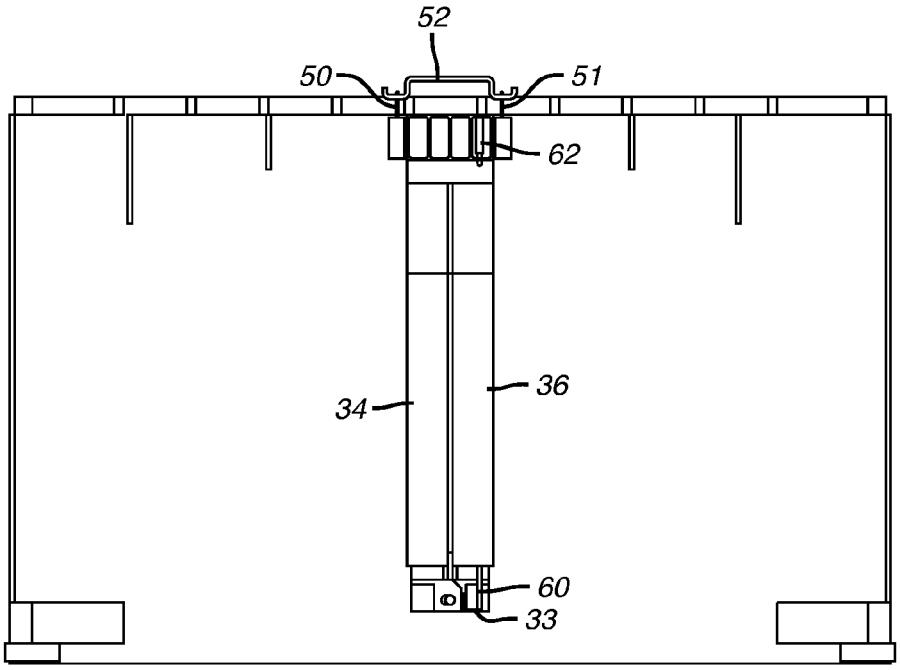
FIG. 14 is a schematic view progressed from FIG. 13 showing the raised panels in the operation of the embodiment of FIGS. 1-6.

Referring to FIGS. 6-15, a holder generally indicated by reference numeral 40 is supported above panels 34, 36 by beam 42 (suitably, as depicted, interconnected extruded aluminum tubing). Beam 42 is secured to an upper extend of sidewalls 24*a*, 24*c*. Holder 40 holds panels 34, 36 upright in the home position depicted in FIGS. 1-2, 4-9 and 14-15. Holder 40 is movable to release the hold on panels 34, 36, allowing the panels to rotate away from each other about axle 32, panel 34 counterclockwise and panel 36 clockwise, to gravitationally swing downward a quarter turn to a horizontal position fixed by location of stops 30*a*, 30*b*, 30*c*, 30*d*. This movement from vertical home position to horizontal is depicted in FIGS. 12-14 and by the path of dashed arrows in FIG. 6.

Holder 40 comprises a pair of latches 46, 48, positioned to extend a latch member 47, 49 alongside an upper portion of the outer side of panels 34, 36 respectively to hold panels 34, 36 upright in home position. Each such latch member 47, 49 is retractable to free its hold on panel 34, 36, respectively, to allow the freed panel to rotate from upright to the horizontal position. In an exemplary embodiment, latches 46, 48 comprise a housing for a spring (not visible), and the latch members 47, 49 are spring biased to extend them alongside an upper portion of the outer side of panels 34, 36 (the outer side here meaning the side facing downward in box 18 when the panels are lowered to horizontal). Retraction of the members 47, 49 loads the spring to exert a force resisting retraction to stage the latch for re-extension of the latch members 47, 49.

Figure 7:
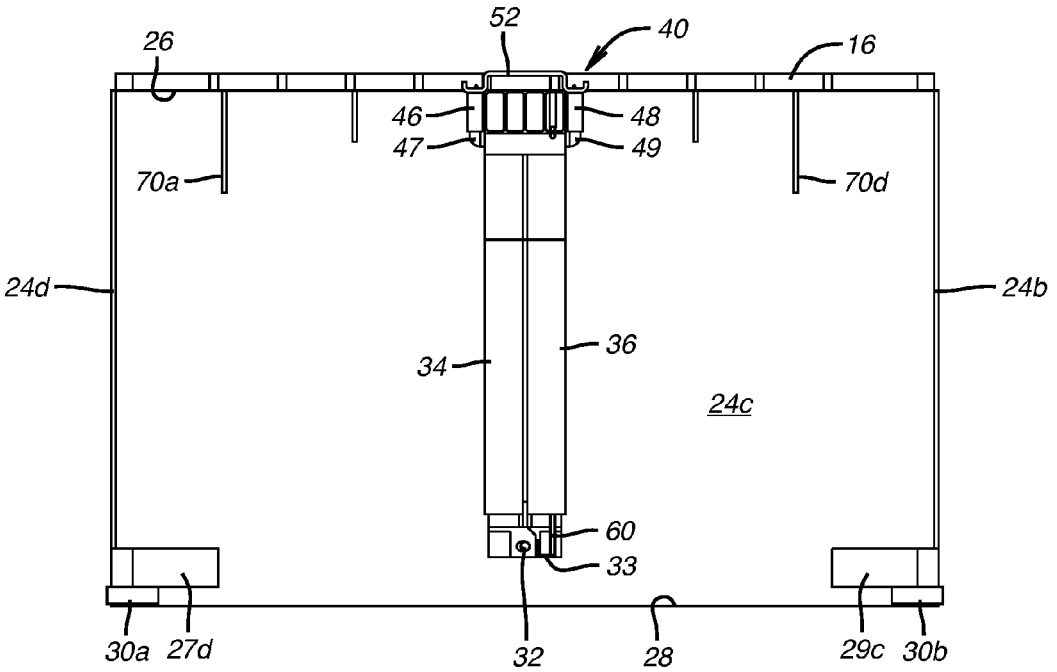
FIG. 7 is a schematic side view of the embodiment of FIG. 6 (a sidewall removed), showing an at-rest position of the embodiment.
Figure 8:
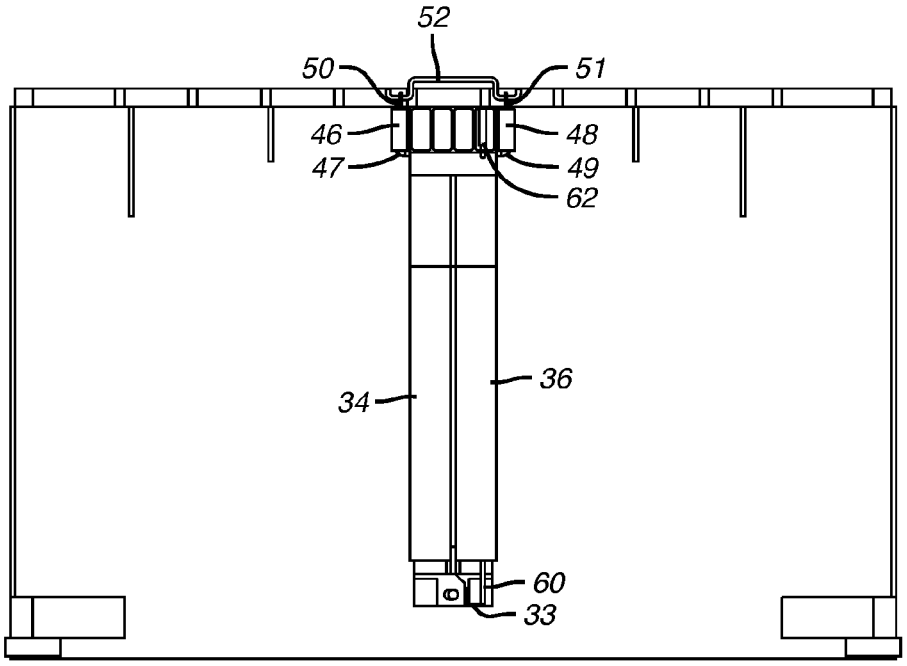
FIG. 8 is the schematic view progressed from FIG. 7 to show the first stage in an activation sequence of the embodiment of FIGS. 1-6.
Figure 9:
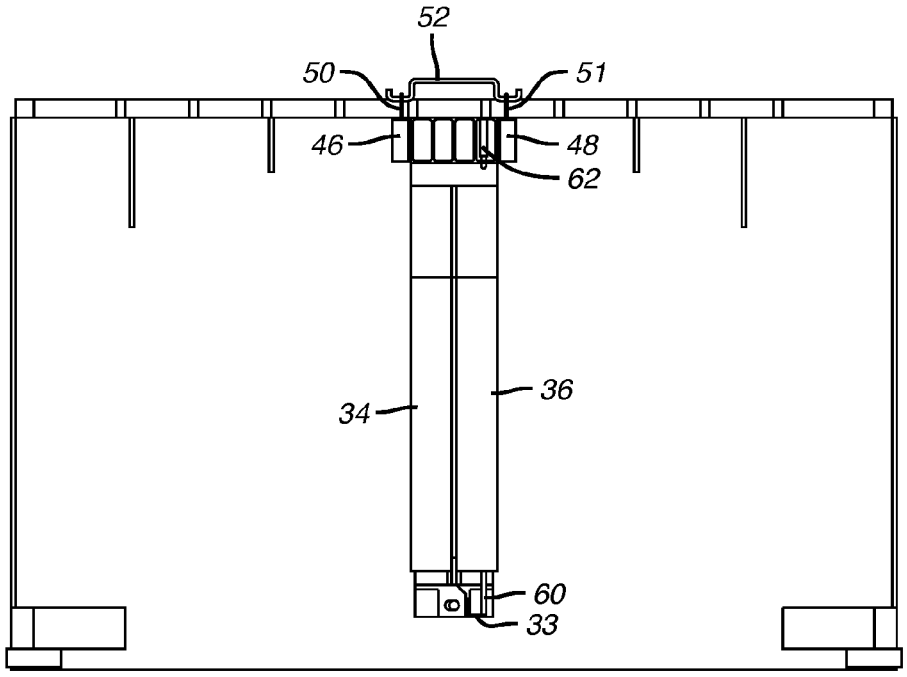
FIG. 9 is a schematic view progressed from FIG. 8 to show the next stage in the activation sequence of the embodiment of FIGS. 1-6.

In an exemplary embodiment, referring particularly to FIG. 7 et seq., holder 40 comprises a pair of staffs 50, 51. Staff 50 vertically extends upwardly from latch member 47 and staff 51 vertically extends upwardly from latch member 49. A handle 52 is structured (i) to grasp staffs 50, 51 when handle 52 is in a position where latch members 47, 49 are extended and holding panels 34, 36, respectively, upright in home position (FIG. 7); (ii) to retain such grasp when handle 52 is manually moved vertically upward to retract latch members 47, 49 (FIGS. 8-9); and (iii) to disengage staffs 50, 51 when latch members 47, 49 are retracted sufficiently to release panels 34, 36, allowing the panels to rotate gravitationally to horizontal and the spring biased latch members to re-extend (FIGS. 10-12).

Figure 15:
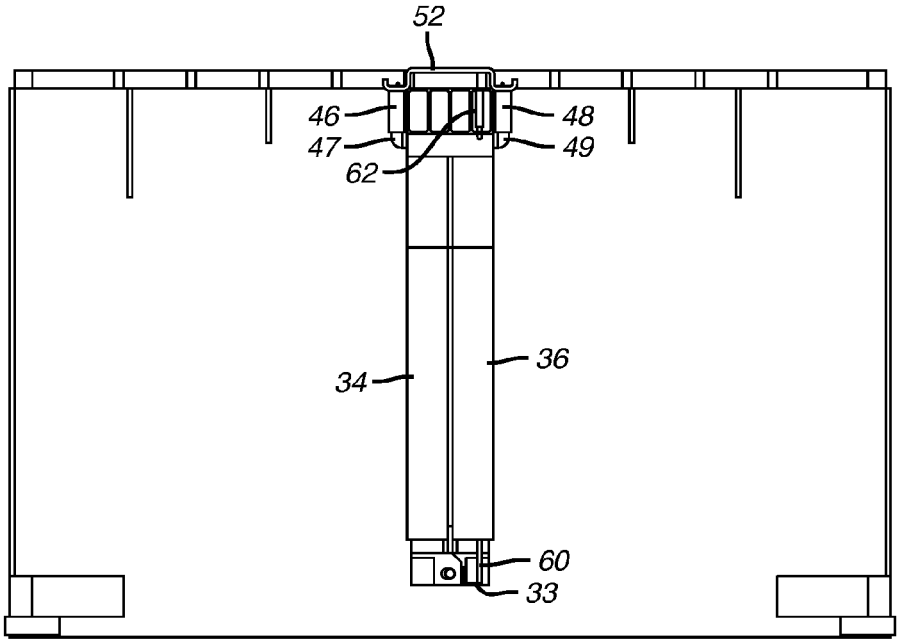
FIG. 15 is a schematic view progressed from FIG. 14 showing the embodiment of FIGS. 1-6 with the raised panels locked in position.
Figure 17:
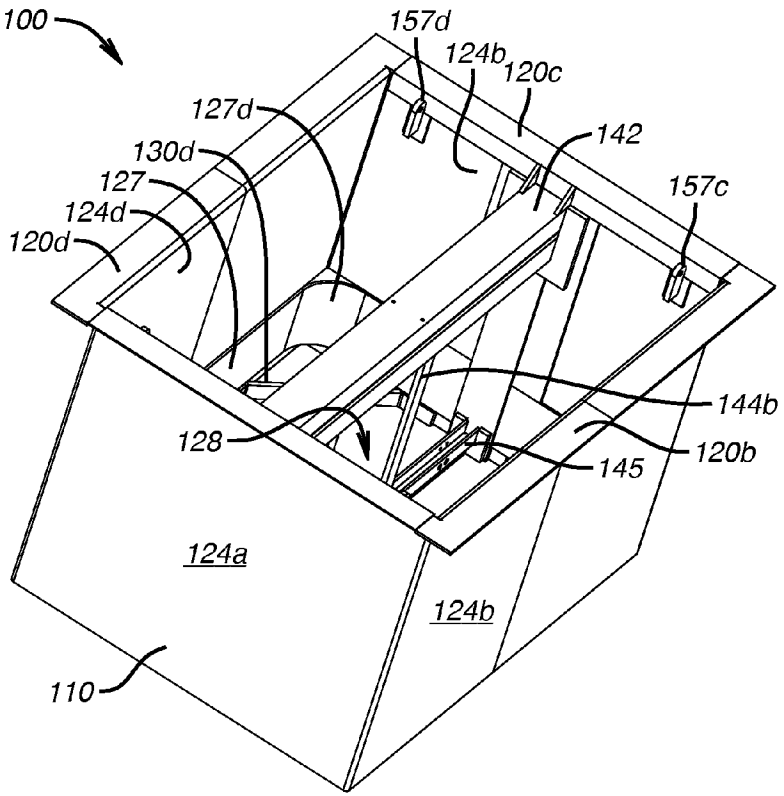
FIG. 17 is another isometric view of the embodiment of FIG. 16 rotated 90 degrees clockwise with panel and panel holders removed for revelation of structure.

In an exemplary embodiment, latch members 47, 49 have an outside cam surface 53, 54 respectively, in their lower portion for engaging a surface of upper inner sides 55, 56 of panels 34, 36, respectively, to cause upper inner sides 55, 56 of panels 34, 36 when raising from horizontal (FIG. 13), to slide along cam surfaces 53, 54 and push the spring biased latch members 47, 49 into a retracted position (FIG. 14), allowing panels 34, 36 to pass by latch members 47, 49 and attain their upright home position, which when attained, allows the spring biased latch members 47, 49 to re-extend the latch members to hold the panels in the home position (FIG. 15).

Referring to FIGS. 10-13 in particular, in an exemplary embodiment, assembly 10 has a panel position indicator comprising a vertical rod 60 moveable with an upper terminus 62 retracted below the top of grating 16 when panels 34, 36 are in their upright home position. Panel position indicator rod 60 is moveably connected at a lower terminus (as by a clevis fastened by pin) to finger 33 projecting from rotatable mount 35 to lift rod 60 when panels 34, 36 rotate away from home position to the horizontal, elevating rod 60 to an extent that rod terminus 62 projects above grating 16 when panels 34, 36 are horizontally deployed. Rod terminus 62 may be marked, for example, by color, for an at-a-glance ease of recognition to verify that panels 34, 36 are deployed to the horizontal position. So deployed, the panels prevent flooding surface waters entering box 18 inside ventilation shaft 12 from pouring into the ventilation ducts connecting vent shaft 12 to the underground structure thereby protected.

Referring to FIG. 6 in particular, in an embodiment a plurality of overhead stiffeners 70*a*, 70*b*, 70*c* and 70*d* run parallel to sidewalls 24*b*, 24*d* and interconnect and brace opposing sidewalls 24*a*, 24*c*, and optionally provide a platform on which grating 16 may rest, and a plurality of inwardly slanted shelves 72*a*, 72*b* outside the arc of travel of panels 34, 36 additionally interconnect and brace sidewalls 24*a*, 24*c* and direct water entering box 18 away from the distal portions of panels 34, 36, where they rest on stops 30, aiding in sealing box 18 when the panels are lowered to the activated position.

Figure 16:
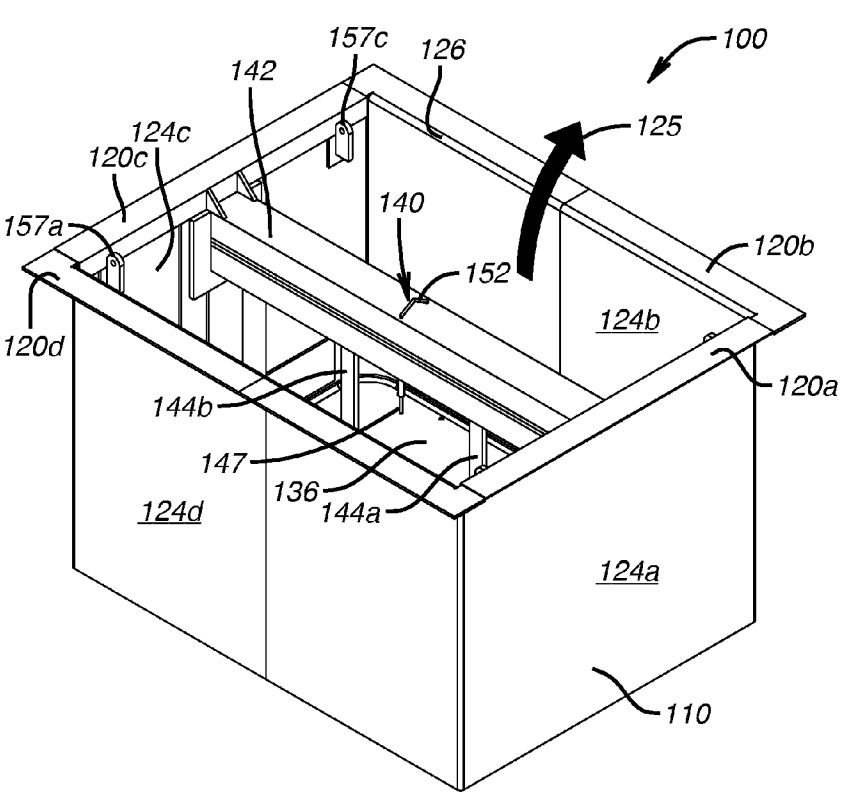
FIG. 16 is an isometric view of another exemplary embodiment of this invention also employing a pair of panels.
Figure 18:
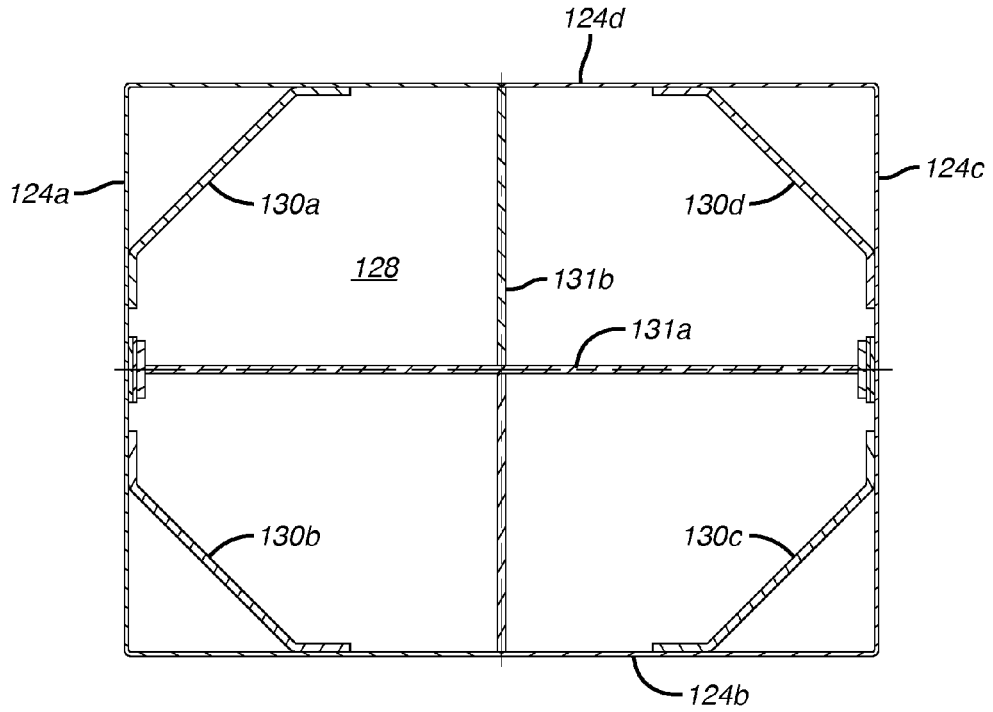
FIG. 18 is a top view of the framework at the base of the embodiment of FIG. 16.
Figure 19:
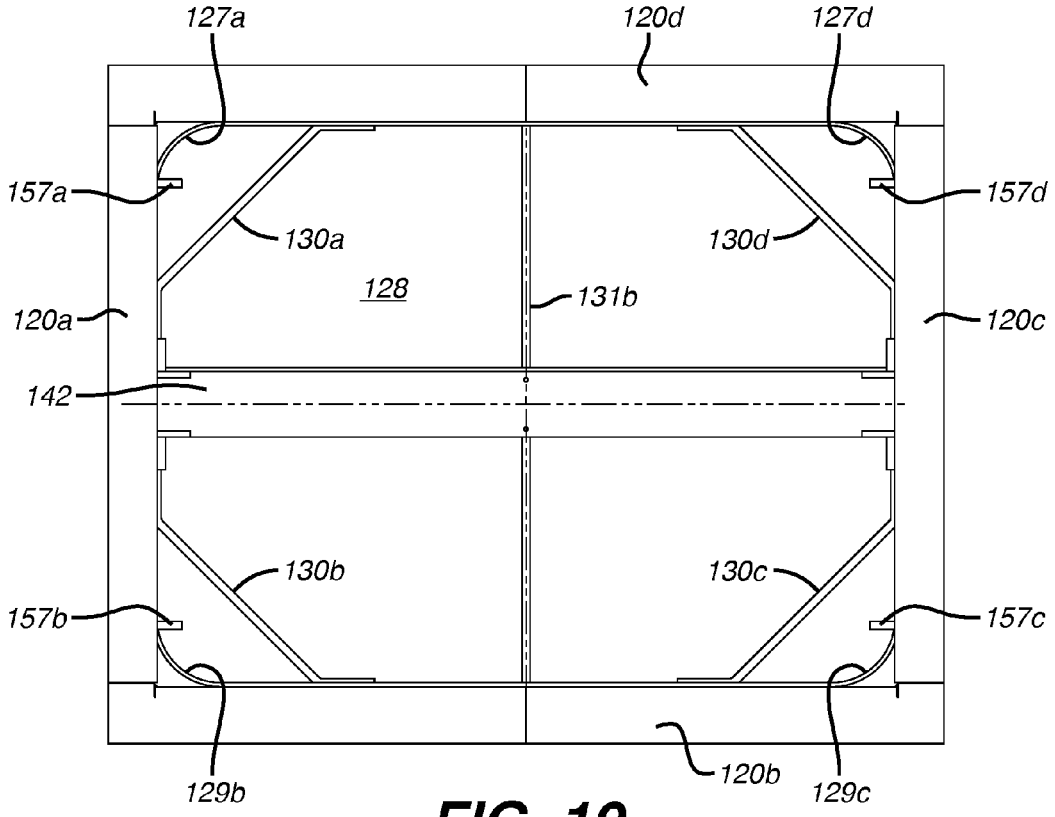
FIG. 19 is top view of the embodiment depicted in of FIG. 17.
Figure 21:
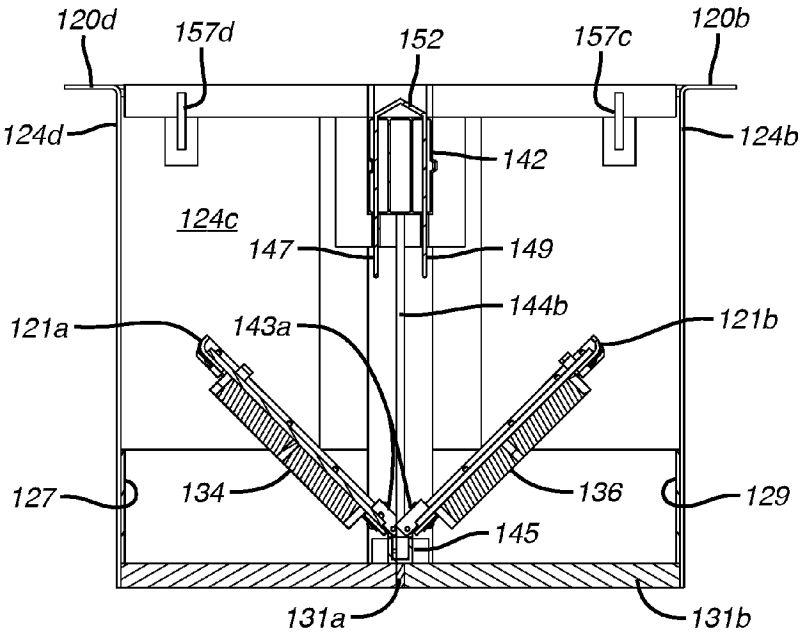
FIG. 21 is a vertical cross sectional schematic view of the embodiment depicted in FIG. 20.
Figure 20:
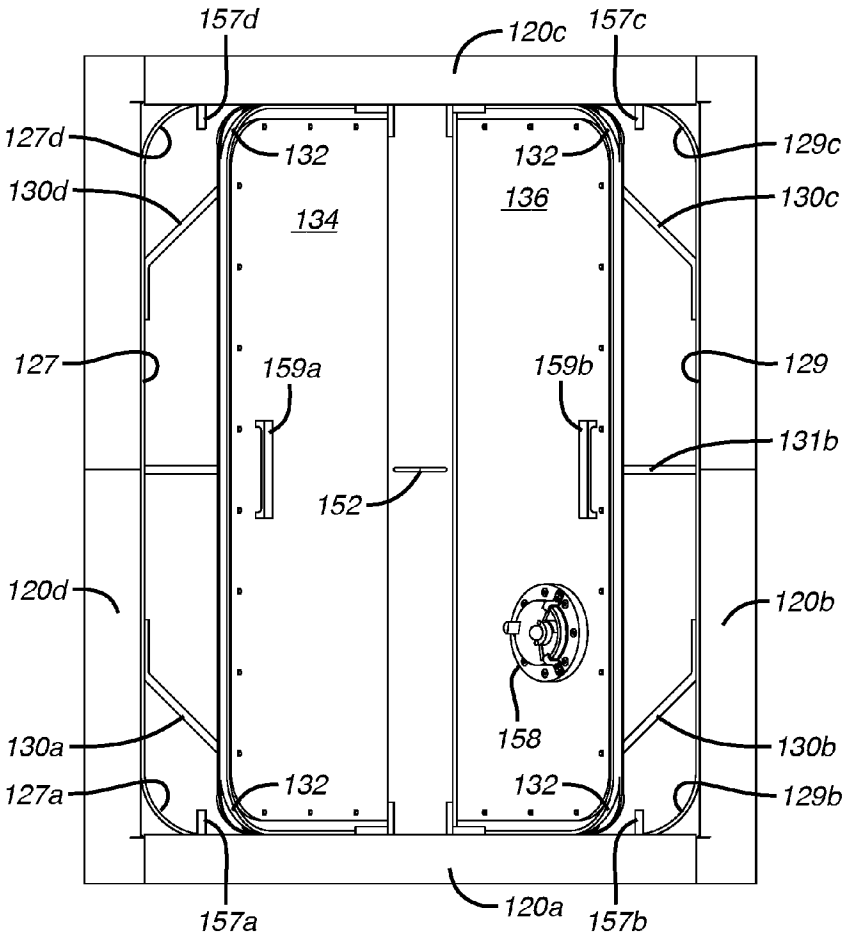
FIG. 20 is a top view of the embodiment depiction in FIG. 16 with panels included and shown in mid-position lowering or rising.
Figure 22:
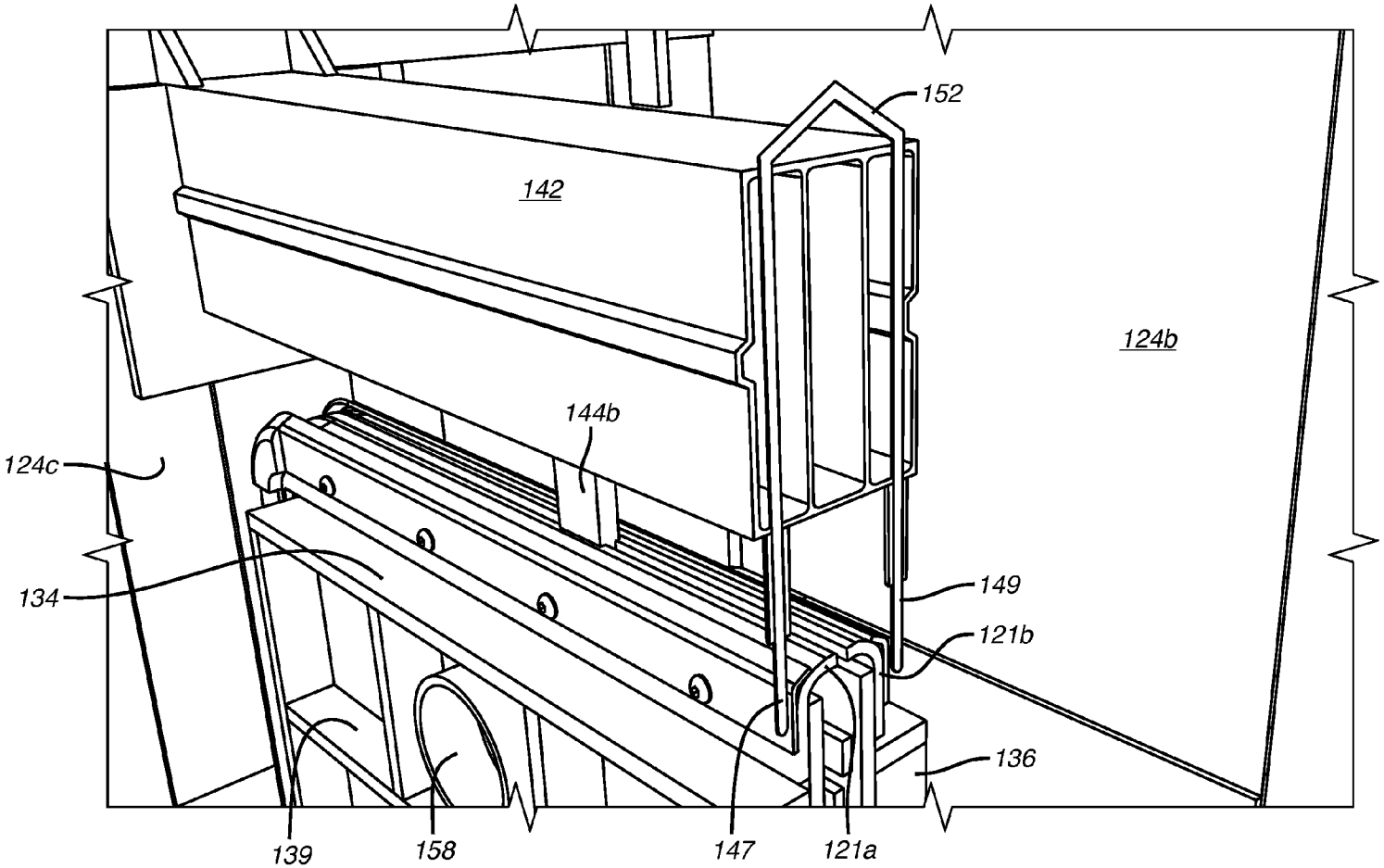
FIG. 22 is a vertical sectional isometric zoomed graphic of panels in locked upright position in the embodiment of FIGS. 16-21
Figure 23:
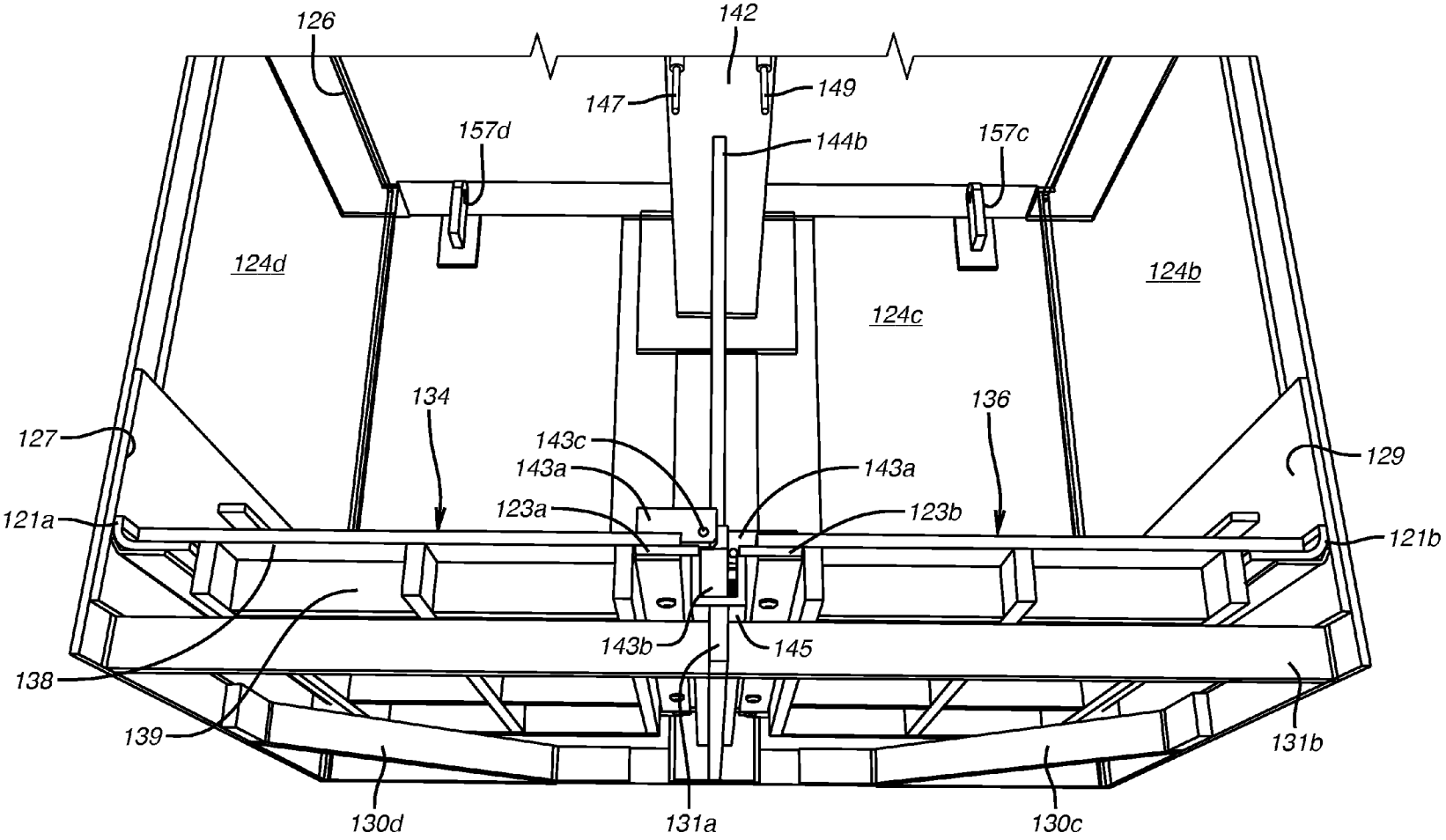
FIG. 23 is a vertical sectional low frontal graphic of the embodiment of FIGS. 16-22 showing the panels in lowered passage blocking position.
Figure 24:
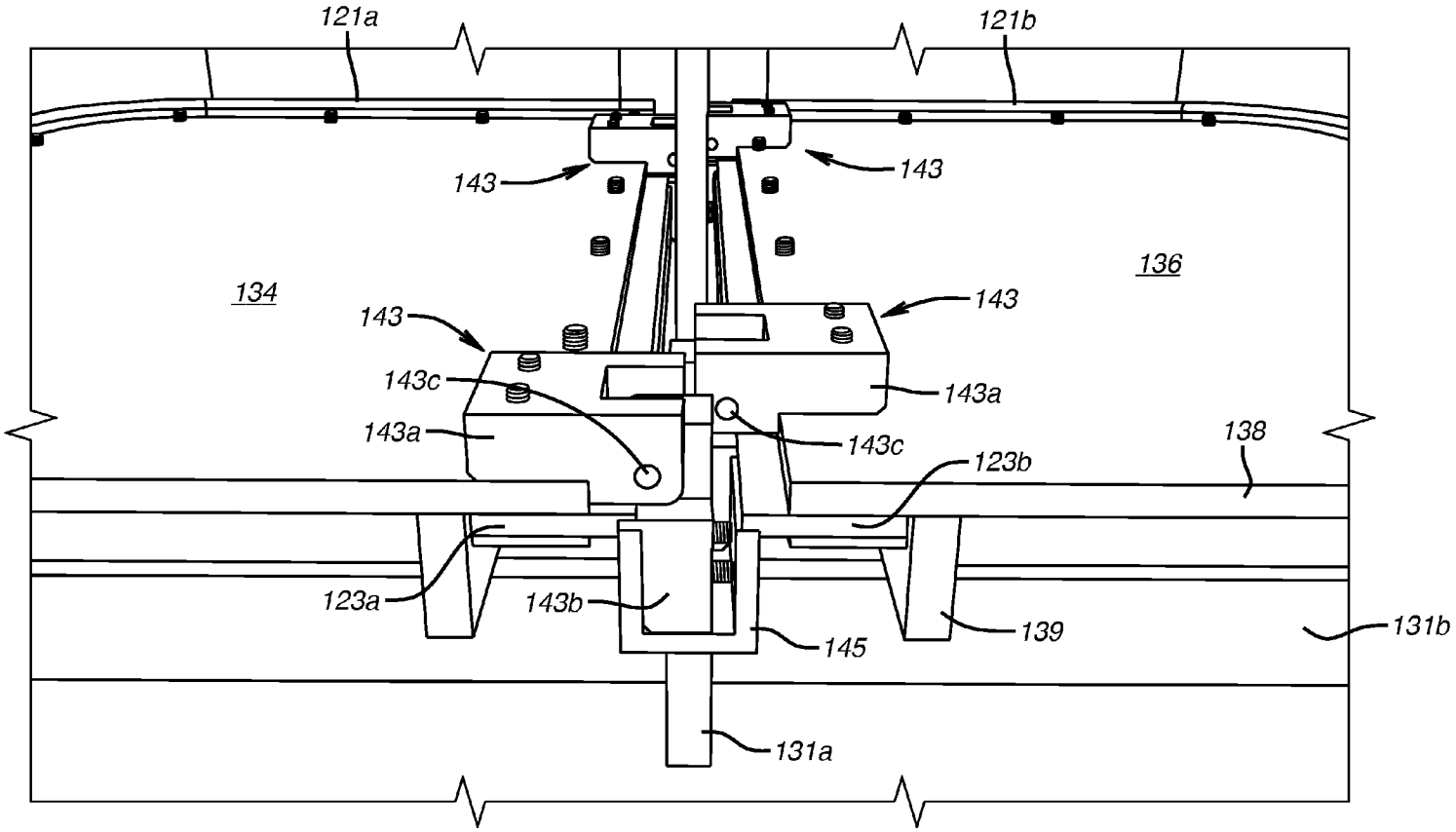
FIG. 24 is a zoomed frontal graphic at a higher elevation than in FIG. 23 showing the mounts for the panels, the panels being in passage blocking position.
Figure 25:
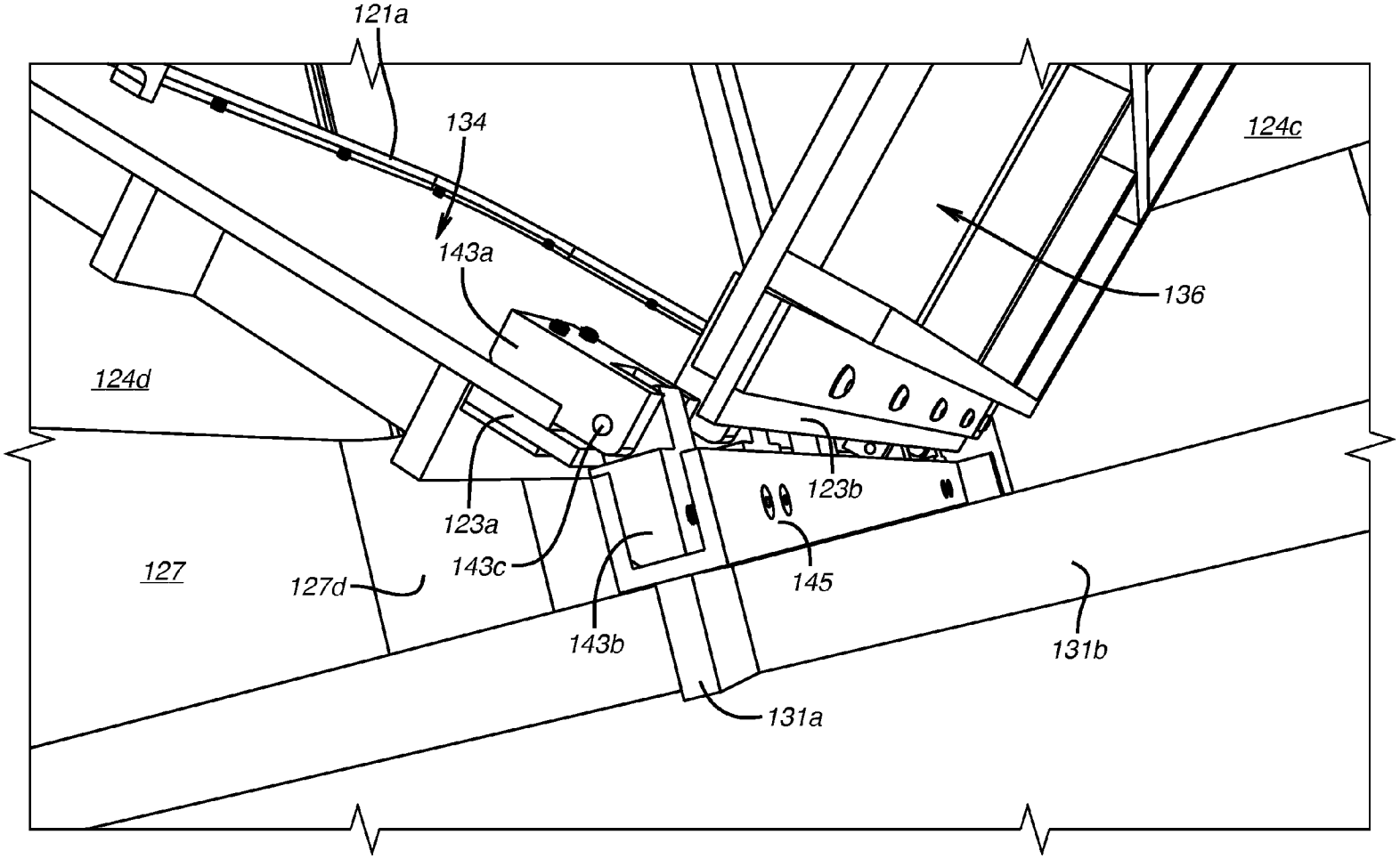
FIG. 25 is an isometric graphic of the mounts shown in FIG. 24 with the panels in mid-position lowering or rising.

Referring now to FIG. 16 et seq., another exemplary embodiment of the invention for preventing downward flow of surface water into an underground ventilation duct fluidly communicating through a ventilation shaft to a rectilinear atmospheric opening of the shaft is apparatus 100. Like the embodiments of FIGS. 1-15, apparatus 100 employs a pair of panels. Apparatus 100 comprises a four-sided box 110 inclusive of sidewalls 124 (124*a*, 124*b*, 124*c*, 124*d*) having at the upper extent of the sidewalls flanges 120 (120*a*, 120*b*, 120*c*, 120*d*) transverse to the sidewalls 124 for extension over a top of walls of a ventilation shaft for suspension of box 110 vertically in the shaft to define a passage 125 between top opening 126 and bottom opening 128 of box 110 for fluid communication of a ventilation duct up through box 110 to an atmospheric top opening 126. Stops 130*a*, 130 *b*, 130*c* and 130 *d* in the form of corner braces and 131*b* (a stiffener support) are within and connected to sidewalls 124 proximate bottom opening 128 and do not obstruct passage 125. A longer stiffener support 131*a* spans across passage 125 connected to sidewalls 124*a*, 124*c*. Adjacent sidewalls include a base 127 having rounded corners 127*a*, 127*d* above respective stops 130*a*, 130*d*, and a base 129 having rounded corners 129*b* and 129*c* above respective stops 130*b*, 130*c*. Rounded corners 127*a*, 127*d* and 129*b*, 129*c* have a round corner radius of curvature.

A beam 142 comprising extruded tubing unobstructively horizontally spans across passage 125 supported by opposed sidewalls 124*a*, 124*c* of box 110 proximate top opening 126. A hinge mount mounting member 145 unobstructively horizontally spans across passage 125 to opposed sidewalls 124*a*, 124*c* of box 110 proximate bottom opening 128. Beam 142 and hinge mount mounting member 145 spanning to the same sidewalls 124*a*, 124*c* are centered in passage 125 of box 110 with beam 142 directly over hinge mounting member 145. A plurality of straps 144*a*, 144*b* connect hinge mounting member 145 to beam 142 providing mid span support to hinge mounting member 145. Hinge mounting member 145 also suitably rests on stiffener support 131.

A plurality of hinge members 143 each comprise a stationary member 143*b*, a movable member 143*a* and a hinge pin 143*c* that interconnects stationary member 143*b* and movable member 143*a*. Stationary member 143*b* connects to hinge mounting member 145.

Positioned within passage 125 are a pair of opposing panels 134, 136. Each panel 134, 136 has proximal and distal portions. Panels 134, 136 have an outer skin 138 at least on upper surfaces and have internal cross braces 139 for rigidity. Moveable hinge members 143*a* attach to the proximal portions of panels 134, 136 for rotation of panels 134, 136 in directions opposite each other from or to an upright home position under beam 142. The home position of the panels tucked under beam 142 does not occlude passage 125. Panels 134, 136 in gravitational rotation fall from the upright home position to a lower passage closing position where further rotation is prevented by stops 130*a*, 130*b*, 130*c*, 130*d* and stiffener support 131*b*. Each panel has a profile that closes the passage when the panels are gravitationally rotated to the passage closing position. The distal portions of the panels have rounded corners 132 with a radius of curvature substantially the same as the radius of curvature of the sidewall corners 129*a*, 129*b*, 129*c* and 129*d* they sweep when rotating to the passage closing position. The panels include one or more peripheral seals 121*a* and 121*b* for sealing the passage in the passage closing position, seal 121*a* for panel 134 and seal 121*b* for panel 136. A gasket seal 123*a* for panel 134, 123*b* for panel 136 spans the proximal ends of bases of panels 134, 136 below pin 143 seals bottom opening 128 at the proximal ends or bases of panels 134, 136. A panel holder 140 includes moveable latch members 147, 149 spring biased to vertically extend the latch members below beam 142 and straddle panels 134, 136 to hold the panels in the upright home. Panel holder 140 has a handle 152 extending above beam 142. Handle 152 is retractable upwardly to raise latch members 147, 149 above panels 134, 136 to release panels 134, 136 and allow the panels to gravitationally rotate downwardly to the passage closing position. Retraction of the extended latch members loads the spring to exert a force resisting retraction to re-extend moveable latch members 147, 149 on release of handle 152. Handle 152 is suitably peaked for easy grasping by a tool that can be inserted through a grate such as grate 16 to grab handle 152 for lifting to release panels 134, 136 to close passage 125.

Apparatus 100 is suitable as a drop in solution to sealing vent passages from storm waters. Lift eyes 157*a*, 157*b*, 157*c*, 157*d* are provided for hoisting apparatus 100 and lowering it into a ventilation shaft to rest on walls of the shaft. At least one of the panels, such as panel 136, may be fitted with a manually closeable and openable drain 158 to allow the limited amount of water captured above the lowered panels to be drained into the shaft where the limited amount capture water can be handled by ventilation system drains and pumps. Panels 134, 136 may be provided with panel handles 159*a*, 159*b* for manually raising the panels after capture water has been removed.

Figure 26:
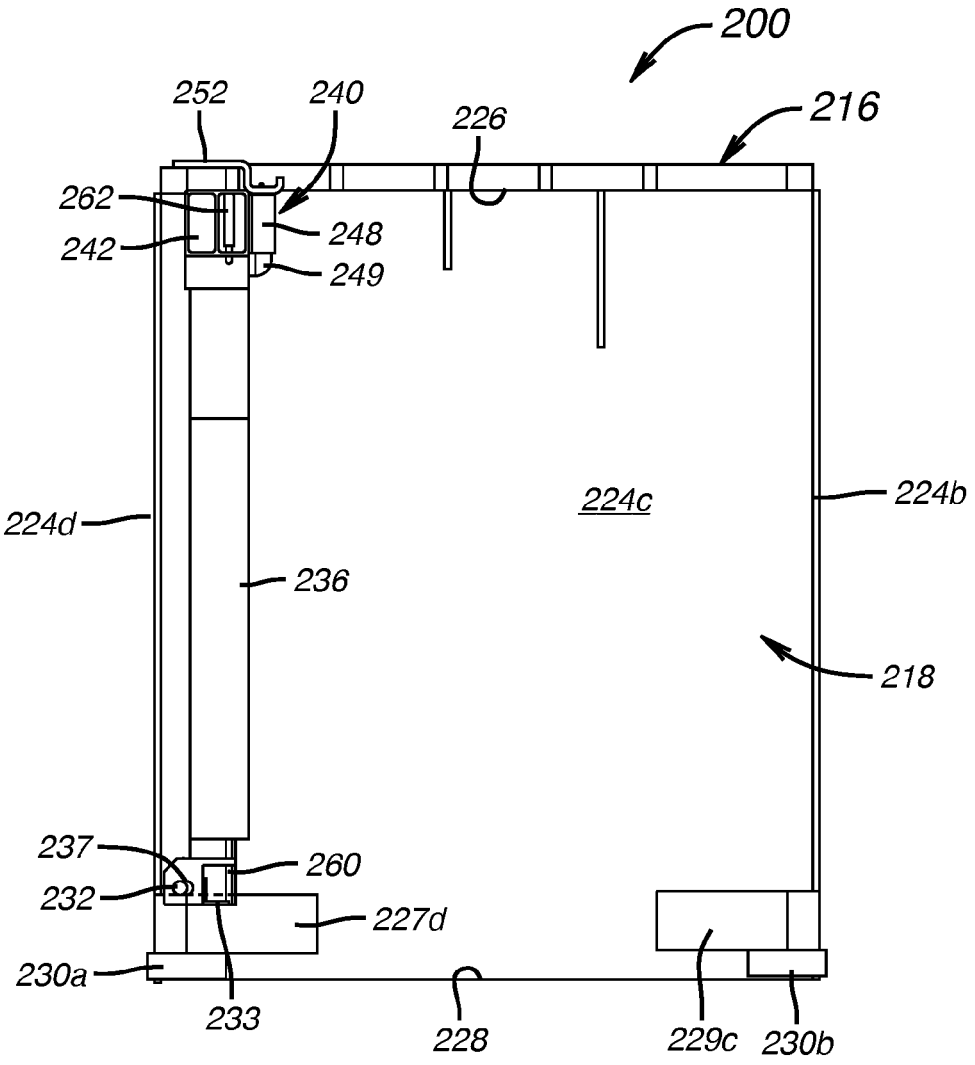
FIG. 26 is a vertical cross sectional schematic view of another exemplary embodiment of the invention in which a single panel is employed.
Figure 27:
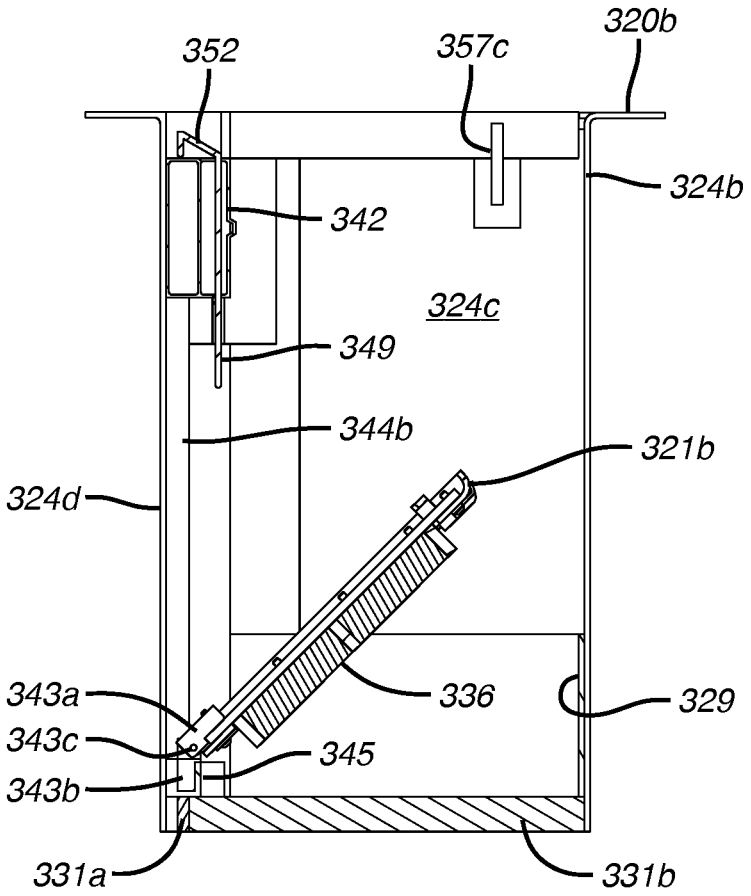
FIG. 27 is a vertical cross sectional schematic view of another exemplary embodiment of the invention in which a single panel is employed.

Referring now to FIG. 26, another exemplary embodiment of this invention is one that employs a single panel. Apparatus 200, as with the other embodiments, assumes a rectilinear atmospheric opening of a vertical ventilation shaft and allows ventilation as usual through the shaft to an underground ventilation duct fluidly communicating through the ventilation shaft to an atmospheric opening at a grating over the shaft and on threat of flooding is operable to prevent downward flow of surface water into the underground ventilation duct. Apparatus 200 comprises a support 210 embodied as a four-sided vertical box 218 open at bottom and top to define a passage 225 between top opening 226 and bottom opening 228 of box 218. As in FIGS. 7-15, some details such as flanges (220) are omitted for simplicity of exposition but will be understood from descriptions of the other embodiment to horizontally extend and rest atop vertical walls of a ventilation shaft (not illustrated in this embodiment but understood from prior embodiments). Sidewalls 224*b*, 224*c* and 224*d* are visible in this sectional view; 224*a* will be understood from descriptions of the embodiments of other embodiment. The four sidewalls 224*a*, 224*b*, 224*c*, 224*d* of box 218 vertically fit inside the four vertical ventilation shaft walls as in the other exemplary embodiments. Stops 230 are within and connected to sidewalls 224 proximate bottom opening 228 where they do not obstruct passage 225. In this cross section, stops 230*a* and 230*b* are visible (stops 230*c* and 230*d* will be understood from the prior embodiments). Adjacent sidewalls include a base 227 having rounded corners 227*a*, 127*d* above respective stops 230*a*, 230*d*, and another base 229 has rounded corners 229*b* and 229*c* above respective stops 230*b*, 230*c*. Rounded corners 227*d* and 229*c* are visible in the FIG. 26 sectional.

A horizontal axle 232 that is perpendicular to opposing sidewalls 224*a*, 224*c* is fixedly supported on bearing surfaces positioning axle 232 adjacently above bottom opening 228 of sidewalls 24. A single panel 236 longitudinally spans between opposing sidewalls 224*a*, 224*c* and is rotationally mounted on horizontal axle 232 by rotatable mount 237. Mount 237 allows panel 236 to rotate downwardly clockwise from the depicted an upright home position not obstructing passage 225, gravitational rotation falling from the upright home position to a lower passage closing position where further rotation is prevented by the stops 230. Panel 236 has a profile that closes passage 225 when the panels gravitationally rotate to the passage closing position.

A holder generally indicated by reference numeral 240 is supported above panel 236 by beam 242 secured to an upper extend of sidewalls 224*a*, 224*c*. Holder 240 holds panel 36 upright in the home position as depicted in FIG. 26. Holder 240 is movable to release the hold on panel 36, allowing panels 236 to rotate clockwise about axle 232 to gravitationally swing downward to a horizontal position fixed by location of stops 230. Holder 240 comprises a latch 248, positioned to extend a latch member 249 alongside an upper portion of the outer side of panel 236 to hold panel 236 upright in home position. Latch member 249 is retractable to free its hold on panel 236 to allow the freed panel to rotate from upright to the horizontal position. In an exemplary embodiment, latch 248 comprises a housing for a spring (not visible), and the latch member 249 is spring biased to extend it alongside an upper portion of the outer side of panel 236 (the outer side here meaning the side facing downward in box 218 when the panels are lowered to horizontal). Retraction of the member 249 loads the spring to exert a force resisting retraction to stage the latch for re-extension of latch member 249.

As in the exemplary embodiment, latch member 249 has an outside curved surface in its lower portion for engaging a surface of the upper inner side of panel 236, to cause that panel surface, when raising from horizontal, to slide along the curved latch member surface to push the spring biased latch member 249 into a retracted position, allowing panel 236 to pass by latch member 249 and attain the upright home position, which when attained, allows the spring biased latch members 249 to re-extend to hold panels 236 in the home position.

Apparatus 200 also has a panel position indicator comprising a vertical rod 260 moveable with an upper terminus 262 retracted below the top of grating 216 when panel 236 is in its upright home position. Panel position indicator rod 260 is moveably connected at a lower terminus (as by a clevis fastened by pin) to a finger 233 projecting from rotatable mount 237 to lift rod 260 when panel 236 rotates away from home position to the horizontal, elevating rod 260 to an extent that rod terminus 262 projects above grating 16 when panel 236 is horizontally deployed. Rod terminus 262 may be marked, for example, by color, for an at-a-glance ease of recognition to verify that panel 236 is deployed to the horizontal position. So deployed, the panels prevent flooding surface waters entering box 218 from pouring into the ventilation ducts connecting the vent shaft to the underground structure thereby protected.

Having described illustrative examples of embodiments that incorporate concepts of the invention, those skilled in the art will be able to use these concepts as guided by these embodiments, and may form alternative variations that nonetheless embrace the concepts herein disclosed and still be within the scope of my invention as claimed in the claims that follow.

The invention claimed is:

1. Apparatus for allowing ventilation through a ventilation shaft to an underground ventilation duct fluidly communicating through the ventilation shaft to an atmospheric opening of the shaft and on threat of flooding operable to prevent downward flow of surface water into the underground ventilation duct, comprising:

a support for arrangement in said shaft defining a passage between top and bottom openings of the support for fluid communication of said ventilation duct up through said support to said atmospheric opening, one or more stops within and connected to said support proximate said bottom opening and not obstructing said passage, one or more panels mounted in said support for rotation upwardly to an upright home position not obstructing said passage and rotation downwardly from said upright home position solely by gravitational impetus on its own weight to a lower passage closing position where further rotation is prevented by said one or more stops, said one or more panels having a profile that closes said passage when said one or more panels gravitationally rotate to said passage closing position, and a panel holder having one or more moveable members holding the one or more panels in said upright home position and having a handle operable to move said one or more moveable members to release the hold of the one or more panels and allow the one or more panels to rotate downwardly solely by gravitational impetus on its own weight to said passage closing position.

2. The apparatus of claim 1 wherein a said panel is mounted to a side of said passage.

3. The apparatus of claim 2 comprising a pair of said panels mounted on opposite sides of said passage.

4. The apparatus of claim 1 comprising a pair of said panels mounted centrally in said passage for rotation of the panels in directions opposite each other from or to said upright home position not obstructing said passage, in gravitational rotation falling from said upright home position to said lower passage closing position.

5. The apparatus of claim 4 in which said shaft is vertical, said atmospheric opening is rectilinear, and said support comprises a four-sided box inclusive of sidewalls sized to internally fit in said shaft between said ventilation duct and said atmospheric opening, said support further comprising flanges transverse to said sidewalls for overlaying a top of said shaft to hang said support in said shaft.

6. The apparatus of claim 5 in which each said one or more panels has a proximal and distal portion, and in which adjacent said sidewalls include a base having rounded corners with a first radius of curvature and in which said distal portions of said panels have rounded corners with a radius of curvature substantially the same as said first radius of curvature of the sidewall corners they sweep when rotating to said passage closing position.

7. The apparatus of claim 6 in which said panels include seals for sealing said passage in said passage closing position.

8. The apparatus of claim 1 in which said holder comprises a latch for each said one or more panels, each latch having a said moveable member, each said latch being positioned to hold said panels upright in said home position, each said moveable member being moveable to free said hold on a said panel held in said upright home position to allow the panel to gravitationally rotate from said upright home position to said passage closing position.

9. The apparatus of claim 8 in which each said latch comprises a spring, movement of said moveable members is vertical, and the latch is spring biased to vertically extend said moveable member, retraction of the extended moveable member loading the spring to exert a force resisting retraction.

10. The apparatus of claim 8 comprising a beam unobstructively horizontally spanning across said passage and connected to opposed sides of said support proximate said top opening.

11. The apparatus of claim 10 in which each said moveable member extends below said beam alongside said one or more panels and holds said one or more panels in said upright home position and in which said handle of the panel holder extends above said beam, said handle being retractable upwardly to raise said moveable member above said one or more panels to release the one or more panels and allow the one or more panels to gravitationally rotate downwardly to said passage closing position.

12. The apparatus of claim 9 in which said holder comprises a staff vertically extending upwardly from each said moveable member and wherein said handle is structured to catch and retain each said staff at a position of rest where the moveable member is extended, to retain such staff upon movement of the handle upwardly to retract said moveable member, and to disengage each said staff when the moveable member is retracted sufficiently to free said one or more panels for rotation gravitationally downwardly to said passage closing position, allowing said spring to extend said moveable latch member.

13. The apparatus of claim 9 in which each said moveable member has an outer surface in its lower portion configured for sliding engagement with a surface of an upper inner side of a panel to cause the panel when raising from horizontal to slide on the outer surface of the moveable member and push the moveable member into a retracted position allowing the panel to pass by the moveable member to attain said upright home position at which said spring extends said moveable member to hold said one or more panels in said home position.

14. The apparatus of claim 1 in which said one or more panels is hingedly rotatable on an axis supported by and horizontally disposed within said support.

15. The apparatus of claim 14 comprising at least one hinge mount comprising a stationary member, a movable member and a hinge pin interconnecting the stationary and movable members, said stationary member being connected to said support, each one or more panels having a proximal and distal portion, each said moveable hinge member attaching to said proximal portions of said one or more panels.

16. The apparatus of claim 15 comprising a hinge mount mounting member unobstructively horizontally spanning across said passage supported between opposed sides of said support proximate said bottom opening, and a beam unobstructively horizontally spanning across said passage and connected to opposed sides of said support proximate said top opening, such opposing sides being the same as the sides to between which said hinge mount mounting member spans.

17. The apparatus of claim 16 comprising a plurality of straps connecting said hinge mount mounting member to said beam.

18. The apparatus of claim 14 in which each said one or more panels is attached to at least one hinge mount hingedly rotatable on an axis supported by and horizontally disposed within said support and further comprising a tell-tale panel position indicator including a vertical rod with an upper terminus positioned at an elevation lower than said atmospheric opening when the one or more panels are in upright home position and a lower terminus moveably connected to a projection from a said hinge mount to move said rod vertically upwardly to elevate said upper terminus above said atmospheric opening when the one or more panels rotates downwardly to said passage closing position.

19. The apparatus of claim 18 in which the upper terminus of the rod is marked for readily visible identification when elevated.

20. The apparatus of claim 1 in which a closable and openable drain is provided in at least one of said one or more panels.

21. The apparatus of claim 1 in at least one of said one or more panels has a handle on a surface of the panel facing said atmospheric opening when such panel is in said passage closing position for manually lifting such panel from said passage closing position toward said home position.

22. Apparatus for allowing ventilation through a ventilation shaft to an underground ventilation duct fluidly communicating through the ventilation shaft to an atmospheric opening of the shaft and on threat of flooding operable to prevent downward flow of surface water into the underground ventilation duct, comprising:

a support for arrangement in said shaft defining a passage between top and bottom openings of the support for fluid communication of said ventilation duct up through said support to said atmospheric opening, one or more stops within and connected to said support proximate said bottom opening and not obstructing said passage, one or more panels mounted in said support for rotation of the one or more panels from or to an upright home position not obstructing said passage, in gravitational rotation falling solely under the impetus of its own weight from said upright home position to a lower passage closing position where further rotation is prevented by said one or more stops, said one or more panels having a profile that closes said passage when said one or more panels gravitationally rotate to said passage closing position, and a latch for each said one or more panels engageable to hold the one or more panels in said upright home position and releasable to release the home position hold of the one or more panels and allow the one or more panels to gravitationally rotate downwardly to said passage closing position.

23. Apparatus for allowing ventilation through a ventilation shaft to an underground ventilation duct fluidly communicating through the ventilation shaft to an atmospheric opening of the shaft and on threat of flooding operable to prevent downward flow of surface water into the underground ventilation duct, comprising:

a support for arrangement in said shaft defining a passage between top and bottom openings of the support for fluid communication of said ventilation duct up through said support to said atmospheric opening, one or more stops within and connected to said support proximate said bottom opening and not obstructing said passage, one or more panels mounted in said support for rotation of the one or more panels from or to an upright home position not obstructing said passage, in gravitational rotation falling from said upright home position to a lower passage closing position where further rotation is prevented by said one or more stops, said one or more panels having a profile that closes said passage when said one or more panels gravitationally rotate to said passage closing position, and a panel holder having one or more moveable members holding the one or more panels in said upright home position and having a handle operable solely by human action to move said one or more moveable members to release the hold of the one or more panels and allow the one or more panels to gravitationally rotate downwardly to said passage closing position.

24. Apparatus for allowing ventilation through a ventilation shaft to an underground ventilation duct fluidly communicating through the ventilation shaft to an atmospheric opening of the shaft and on threat of flooding operable to prevent downward flow of surface water into the underground ventilation duct, comprising:

a support for arrangement in said shaft defining a passage between top and bottom openings of the support for fluid communication of said ventilation duct up through said support to said atmospheric opening, one or more stops within and connected to said support proximate said bottom opening and not obstructing said passage, one or more panels mounted in said support for rotation of the one or more panels from or to an upright home position not obstructing said passage, in gravitational rotation falling from said upright home position to a lower passage closing position where further rotation is prevented by said one or more stops, said one or more panels having a profile that closes said passage when said one or more panels gravitationally rotate to said passage closing position, and a latch for each said one or more panels engageable to hold the one or more panels in said upright home position and releasable by human action to release the home position hold of the one or more panels and allow the one or more panels to gravitationally rotate downwardly to said passage closing position.

* * * * *